US009448517B2

(12) United States Patent
Tobinaga et al.

(10) Patent No.: US 9,448,517 B2
(45) Date of Patent: Sep. 20, 2016

(54) IMAGE FORMING APPARATUS

(71) Applicants: Hideki Tobinaga, Kanagawa (JP); Hajime Nishida, Kanagawa (JP); Satoshi Kuno, Tokyo (JP); Jumpei Aoyama, Kanagawa (JP); Junpei Kamichi, Tokyo (JP); Shun Kobayashi, Kanagawa (JP)

(72) Inventors: Hideki Tobinaga, Kanagawa (JP); Hajime Nishida, Kanagawa (JP); Satoshi Kuno, Tokyo (JP); Jumpei Aoyama, Kanagawa (JP); Junpei Kamichi, Tokyo (JP); Shun Kobayashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 20 days.

(21) Appl. No.: 14/638,158

(22) Filed: Mar. 4, 2015

(65) Prior Publication Data

US 2015/0253715 A1 Sep. 10, 2015

(30) Foreign Application Priority Data

Mar. 5, 2014 (JP) ..... 2014-042405
Sep. 19, 2014 (JP) ..... 2014-191467

(51) Int. Cl.
*G03G 21/16* (2006.01)
*G03G 21/00* (2006.01)
*G03G 15/23* (2006.01)

(52) U.S. Cl.
CPC ..... *G03G 15/231* (2013.01); *G03G 21/1623* (2013.01); *G03G 21/1638* (2013.01); *G03G 2215/00544* (2013.01)

(58) Field of Classification Search
CPC ..... G03G 21/16; G03G 2221/1675; G03G 21/1623; G03G 21/1633; G03G 21/1638; G03G 15/70; G03G 2215/00548; G03G 2215/00544
See application file for complete search history.

(56) References Cited

U.S. PATENT DOCUMENTS 5,961,226 A 10/1999 Nishida
2005/0253323 A1 11/2005 Fujita et al.
(Continued)

FOREIGN PATENT DOCUMENTS

JP 2002012336 A * 1/2002
JP 2002-307737 10/2002
(Continued)

OTHER PUBLICATIONS

U.S. Appl. No. 14/536,955, filed Nov. 10, 2014.
(Continued)

*Primary Examiner* — Robert Huber
*Assistant Examiner* — John M Royston
(74) *Attorney, Agent, or Firm* — Harness, Dickey & Pierce, P.L.C.

(57) ABSTRACT

An image forming apparatus includes an image forming part to form an image on a recording medium, an apparatus body, a sheet container detachably attachable to the apparatus body and accommodating the recording medium, a sheet conveying path through which the recording medium is conveyed toward the image forming part, a sheet reentry path disposed above the sheet container and through which the recording medium having the image thereon is conveyed again to the sheet conveying path, a swing unit to swingably move a bottom plate of the sheet reentry path between a first position and a second position, a lock releasing unit to lock and release the bottom plate with respect to the first position of the swing unit, and a release operating unit to cause the lock releasing unit to release the bottom plate from the first position of the swing unit.

33 Claims, 30 Drawing Sheets

(56) References Cited

U.S. PATENT DOCUMENTS

| | | | | |
|---|---|---|---|---|
| 2006/0132573 | A1 | 6/2006 | Nishida | |
| 2006/0181589 | A1 | 8/2006 | Nishida | |
| 2011/0157664 | A1* | 6/2011 | Samoto et al. | 358/498 |
| 2014/0183813 | A1 | 7/2014 | Aoyama | |
| 2014/0210157 | A1 | 7/2014 | Aoyama | |
| 2014/0212195 | A1 | 7/2014 | Aoyama | |

FOREIGN PATENT DOCUMENTS

| | | |
|---|---|---|
| JP | 2003-091117 | 3/2003 |
| JP | 2003-122072 | 4/2003 |
| JP | 2003-295733 | 10/2003 |
| JP | 2010-085622 | 4/2010 |
| JP | 2012-168413 | 9/2012 |

OTHER PUBLICATIONS

U.S. Appl. No. 14/533,449, filed Nov. 5, 2014.

* cited by examiner

IMAGE FORMING APPARATUS

CROSS-REFERENCE TO RELATED APPLICATIONS

This patent application is based on and claims priority pursuant to 35 U.S.C. §119(a) to Japanese Patent Application Nos. 2014-042405, filed on Mar. 5, 2014, and 2014-191467, filed on Sep. 19, 2014, in the Japan Patent Office, the entire disclosure of each of which is hereby incorporated by reference herein.

BACKGROUND

1. Technical Field

This disclosure relates to an image forming apparatus to convey a recording medium to a sheet conveying path provided to an image forming part via a sheet reentry path for duplex copying when the recording medium has an image on a first surface thereof and no image on a second surface thereof.

2. Related Art

As an example of known image forming apparatus, some image forming apparatuses have a sheet reentry path for conveying a sheet as a recording medium having a first image formed on a first surface thereof for duplex copying for a second image to be formed on a second surface thereof.

For example, in a comparative image forming apparatus having the above-described configuration, a charger uniformly charges a photoconductor that rotates while being charged. Then, an optical writing device emits a light beam to irradiate the charged photoconductor, so that an electrostatic latent image is formed on the photoconductor. A developing device develops the electrostatic latent image formed on the photoconductor into a visible toner image. By so doing, the toner image is transferred onto a sheet conveyed between the photoconductor and a transfer device.

A sheet tray that is detachably attachable to an apparatus body contains the sheet therein so as to supply the sheet to an image forming part. The leading end of the sheet that is contained in the sheet tray is in contact with a sheet feed roller. As the sheet feed roller rotates, the sheet is fed to a sheet conveying path.

The sheet fed from the sheet tray is conveyed to a transfer nip region formed between the photoconductor and the transfer device of the image forming part. After the toner image formed on the photoconductor is transferred onto the sheet in the transfer nip region, the sheet is conveyed to a fixing device to fix the toner image to the sheet. Residual toner remaining on the photoconductor is removed by a cleaning blade that is disposed in contact with the photoconductor.

Thereafter, the sheet reaches a position where a switching claw is disposed to change its direction whether the sheet is discharged to an outside of the comparative image forming apparatus via a sheet discharging path or is conveyed to the sheet conveying path again via a sheet reversing unit and a sheet reentry path.

The sheet is conveyed to the sheet conveying path again for duplex printing and is reversed upside down in a sheet reversing unit. Then, the sheet is conveyed via the sheet reentry path disposed immediately above the sheet tray to the sheet conveying path. Then, when the sheet passes through the image forming part, a toner image is formed on the rear surface of the sheet. The toner image formed on the rear surface on the sheet is fixed to the sheet in the fixing device. Accordingly, the toner images are formed on both surfaces of the sheet.

SUMMARY

At least one aspect of this disclosure provides an image forming apparatus including an image forming part, an apparatus body, a sheet container, a sheet conveying path, a sheet reentry path, a swing unit, a lock releasing unit, and a release operating unit. The image forming part forms an image on a recording medium having a first surface and a second surface. The apparatus body contains the image forming part therein. The sheet container is detachably attachable to the apparatus body and accommodates the recording medium to be supplied to the image forming part. The sheet conveying path is a path through which the recording medium is conveyed from the sheet container toward the image forming part. The sheet reentry path is disposed above the sheet container in the apparatus body and through which the recording medium having the image formed on the first surface thereof by the image forming part is conveyed again to the sheet conveying path to receive an image on the second surface of the recording medium. The sheet reentry path has a floor including at least a bottom plate. The swing unit swingably moves the bottom plate between a first position to form the floor of the sheet reentry path and a second position to expose an inside of the sheet reentry path toward a space generated in the apparatus body by detachment of the sheet container as the bottom plate of the floor of the sheet reentry path swings. The lock releasing unit is provided in the apparatus body and locks and releases the bottom plate of the sheet reentry path with respect to the first position of the swing unit. The release operating unit causes the lock releasing unit to release the bottom plate from the first position of the swing unit.

DETAILED DESCRIPTION

Figure 1:
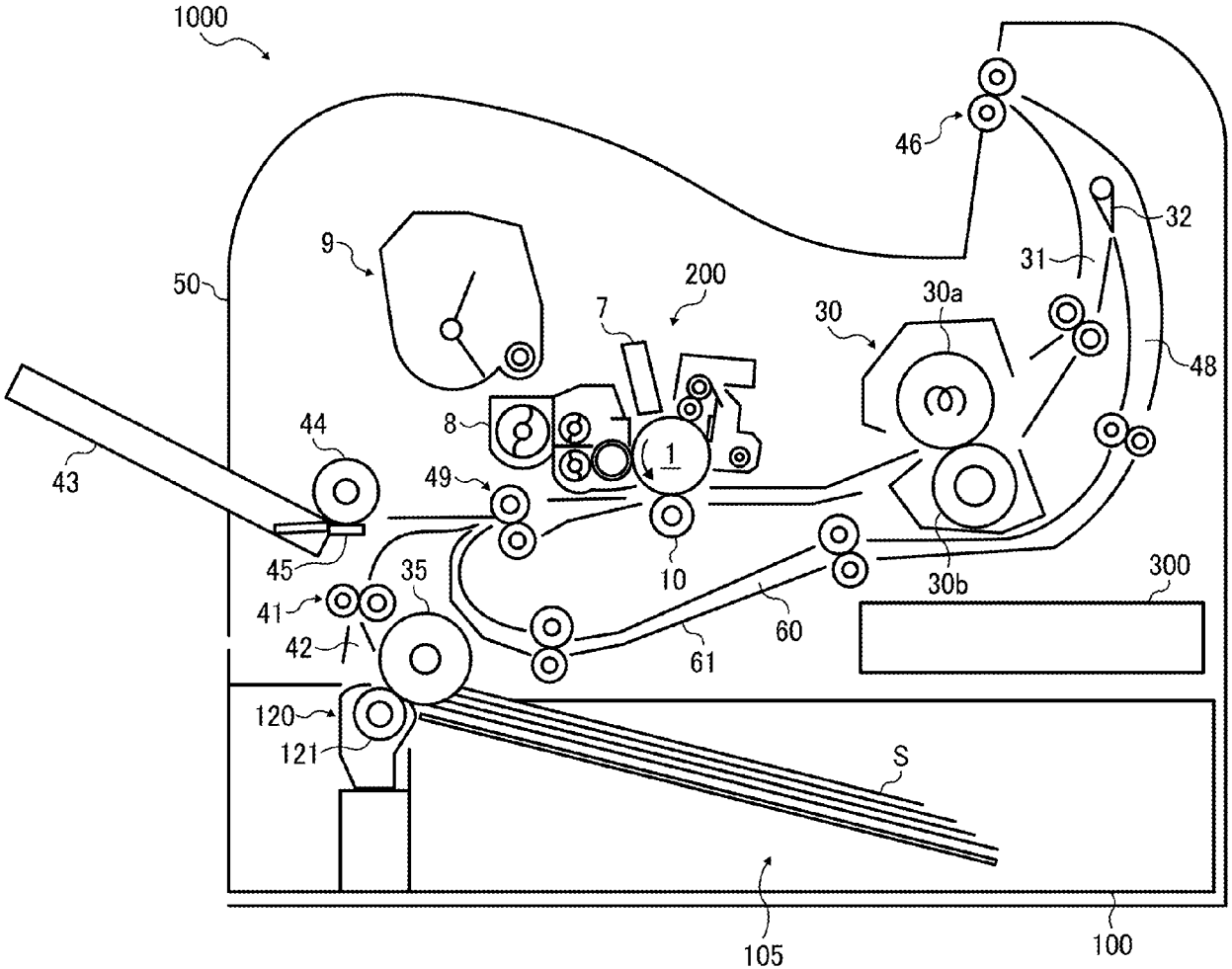
FIG. 1 is a diagram illustrating a schematic configuration of an image forming apparatus according to an example of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Now, a description is given of an electrophotographic image forming apparatus 1000 for forming images by electrophotography.

The image forming apparatus 1000 may be a copier, a printer, a scanner, a facsimile machine, a plotter, and a multifunction peripheral or a multifunction printer (MFP) having at least one of copying, printing, scanning, facsimile, and plotter functions, or the like. According to the present example, the image forming apparatus 1000 is an electrophotographic printer that forms toner images on a sheet or sheets by electrophotography.

Further, it is to be noted that this disclosure is also applicable to image forming apparatuses adapted to form images through other schemes, such as known ink jet schemes, known toner projection schemes, or the like as well as to image forming apparatuses adapted to form images through electro-photographic schemes.

It is also to be noted in the following examples that the term "sheet" is not limited to indicate a paper material but also includes OHP (overhead projector) transparencies, OHP film sheets, coated sheet, thick paper such as post card, thread, fiber, fabric, leather, metal, plastic, glass, wood, and/or ceramic by attracting developer or ink thereto, and is used as a general term of a recorded medium, recording medium, sheet member, and recording material to which the developer or ink is attracted.

At first, a description is given of a basic configuration of the image forming apparatus 1000 according to an example of this disclosure.

FIG. 1 is a schematic diagram illustrating the image forming apparatus 1000 according to this example.

In FIG. 1, the present image forming apparatus 1000 includes an apparatus body 50, a photoconductor 1, and a sheet tray 100. The photoconductor 1 functions as a latent image bearer. The sheet tray 100 functions as a sheet container that is detachably attachable to the apparatus body 50.

The sheet tray 100 includes multiple sheets S in a form of a sheet bundle.

A sheet S in the sheet tray 100 is fed from the sheet tray 100 as a sheet feed roller 35 rotates, passes through a sheet separation nip region, and reaches a sheet conveying path 42. Thereafter, the sheet S is held by a first conveying roller pair 41 in the sheet conveying nip region and is conveyed from an upstream side toward a downstream side in the sheet conveying direction in the sheet conveying path 42. A registration roller pair 49 is disposed in a vicinity of a terminal end of the sheet conveying path 42. During the abutment of the sheet S, skew of the sheet S is corrected.

The registration roller pair 49 starts driving to feed the sheet S toward the transfer nip region so as to synchronize rotation of the registration roller pair 49 with movement of the sheet S, so that the toner image formed on the surface of the photoconductor 1 is transferred onto the sheet S in a transfer nip region. At this time, the first conveying roller pair 41 starts driving at the same time as the rotation of the registration roller pair 49 to resume conveyance of the sheet S that has been halted.

The apparatus body 50 of the image forming apparatus 1000 contains a bypass tray unit including a bypass tray 43, a bypass feed roller 44, a sheet separation pad 45. The sheet S that is loaded on the bypass tray 43 of the bypass tray unit is fed from the bypass tray 43 due to rotation of the bypass feed roller 44. After passing through the sheet separation nip region formed by the bypass feed roller 44 and the sheet separation pad 45, the sheet S enters an upstream region located upstream from the registration roller pair 49 in the sheet conveying path 42 in the sheet conveying direction. Thereafter, similarly to the sheet S discharged from the sheet tray 100, the sheet S is conveyed to the transfer nip region after passing through the registration roller pair 49.

Figure 2:
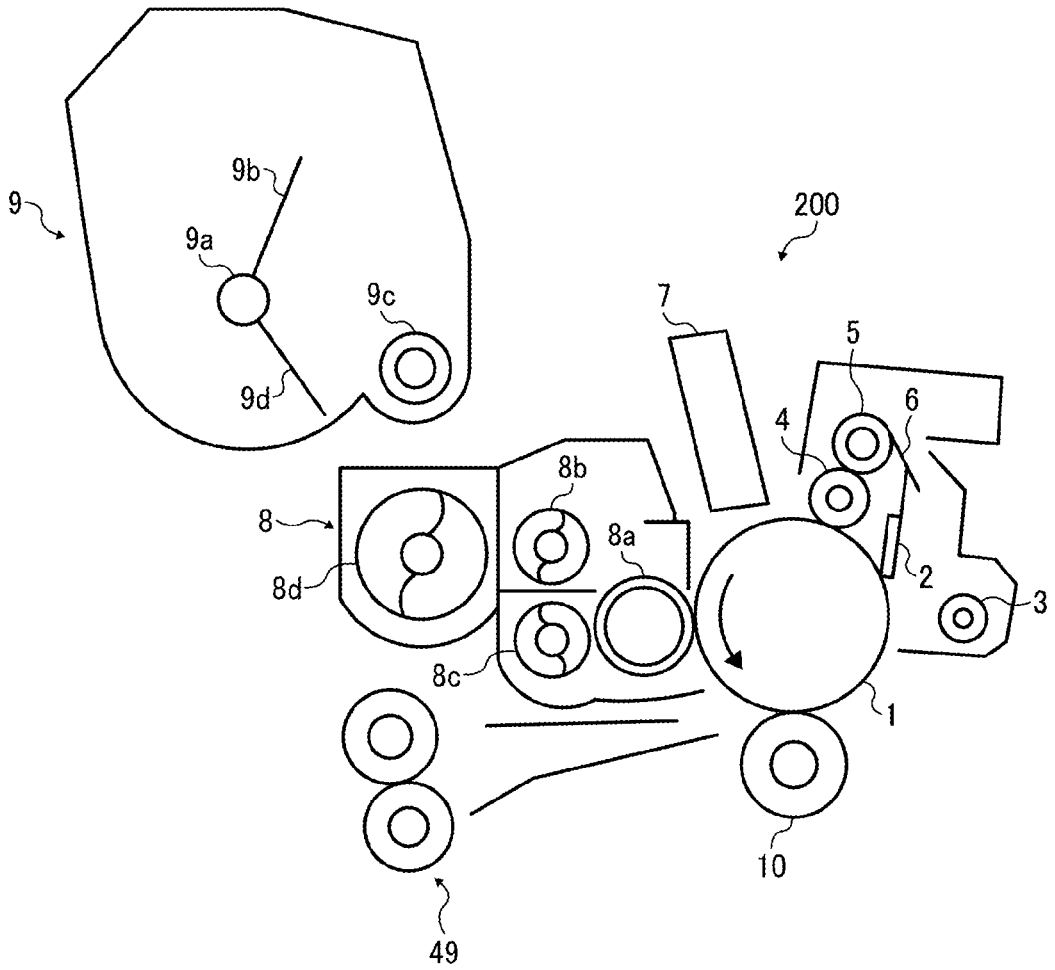
FIG. 2 is an enlarged view illustrating an image forming part including a photoconductor and image forming units disposed around the photoconductor included in the image forming apparatus of FIG. 1.

FIG. 2 is an enlarged view illustrating an image forming part 200 including the photoconductor 1 and image forming devices disposed around the photoconductor 1 included in the image forming apparatus 1000 of FIG. 1.

The photoconductor 1 is a drum-shaped photoconductor that rotates clockwise in FIG. 2. The image forming devices disposed around the photoconductor 1 are a toner collection screw 3, a cleaning blade 2, a charging roller 4, a latent image writing device 7, a developing device 8, a transfer roller 10, and the like.

The charging roller 4 includes a conductive rubber roller and forms a charging nip region by rotating while being in contact with the photoconductor 1. A charging bias that is outputted from a power source is applied to the charging roller 4. Thus, in the charging nip region, an electrical discharge is induced between the surface of the photoconductor 1 and a surface of the charging roller 4. As a result, the surface of the photoconductor 1 is uniformly charged.

The latent image writing device 7 includes an LED (light-emitting diode) array and performs light scanning with LED light over the surface of the photoconductor 1 that has been uniformly charged. On a ground surface of the photoconductor 1 that has been uniformly charged, the area having been subjected to the light irradiation through this light scanning attenuates the electric potential therein. This results in formation of an electrostatic latent image on the surface of the photoconductor 1.

As the photoconductor 1 rotates, the electrostatic latent image passes through a development region that is located facing the developing device 8. The developing device 8 includes a circulation conveying portion and a developing portion. The circulation conveying portion accommodates developer containing toner and magnetic carriers. The circulation conveying portion includes a first screw **8*b* for conveying the developer to be supplied to a developing roller 8***a*, a second screw 8*c* for conveying the developer in an independent space positioned beneath the first screw 8*b*. Further, the circulation conveying portion includes an inclined screw 8*d* for receiving the developer from the second screw 8*c* and supplying the developer to the first screw 8*b*. The developing roller 8*a*, the first screw 8*b*, and the second screw 8*c* are placed at attitudes parallel with each other. By contrast, the inclined screw 8*d* is placed at an attitude inclined with respect to the developing roller 8*a*, the first screw 8*b*, and the second screw 8*c*.

The first screw 8*b* conveys the developer from a distal side toward a proximal side in a direction perpendicular to the drawing sheet of FIG. 2 as the first screw 8*b* rotates. At this time, the first screw 8*b* supplies a portion of the developer to the developing roller 8*a* that is disposed opposite to the first screw 8*b*. The developer having been conveyed by the first screw 8*b* to the vicinity of a proximal end portion of the first screw 8*b* in the direction perpendicular to the drawing sheet of FIG. 2 is dropped onto the second screw 8*c*.

The second screw 8*c* receives used developer from the developing roller 8*a* and, at the same time, conveys the received developer from the distal side toward the proximal side in the direction perpendicular to the drawing sheet of FIG. 2 as the second screw 8*c* rotates. The developer conveyed by the second screw 8*c* to the vicinity of the end portion thereof that is close in the direction perpendicular to the drawing sheet of FIG. 2 is supplied to the inclined screw 8*d*. Further, along with rotation of the inclined screw 8*d*, the developer is conveyed from the proximal side toward the distal side in the direction perpendicular to the drawing sheet of FIG. 2. Thereafter, the developer is supplied to the first screw 8*b* in the vicinity of the distal end portion thereof in the direction perpendicular to the drawing sheet of FIG. 2.

The developing roller 8*a* includes a rotatable developing sleeve and a magnet roller. The rotatable developing sleeve is a tubular-shaped non-magnetic member. The magnet roller is fixed to the developing sleeve in such a way as not to rotate together with the developing sleeve. Further, the developing roller 8*a* takes up a portion of the developer that is conveyed by the first screw 8*b* onto the surface of the developing sleeve due to a magnetic force generated by the magnet roller. The developer that is carried on the surface of the developing sleeve passes through an opposite position facing a doctor blade. At this time, the thickness of a layer of the developer on the surface of the developing sleeve is regulated while the developer is rotated together with the surface of the development sleeve. Thereafter, the developing roller 8*a* moves while sliding on the surface of the photoconductor 1 in the developing area in which the developing roller 8*a* faces the photoconductor 1.

A development bias having the same polarity as the toner and an electric potential at the surface of the photoconductor 1 is applied to the developing sleeve. The absolute value of this development bias is greater than the absolute value of electric potential of the latent image and is smaller than the absolute value of the electric potential at the surface. Therefore, in the development area, a development potential acts between the developing sleeve and the electrostatic latent image formed on the photoconductor 1 in such a way as to electrostatically move the toner from the developing sleeve to the latent image. By contrast, a background potential acts between the development sleeve and the ground surface of the photoconductor 1 to electrostatically move the toner from the background surface to the developing sleeve. This causes the toner to selectively adhere to the electrostatic latent image formed on the photoconductor 1, so that the electrostatic latent image is developed in the development area.

The developer that has passed through the development area enters an opposite area in which the developing sleeve faces the second screw 8*c* as the developing sleeve rotates. In the opposite area, a repulsive magnetic field is formed by two magnetic poles having polarities different from each other out of multiple magnetic poles included in the magnet roller. The developer that has entered the opposite area is separated from the surface of the developing sleeve and is collected by the second screw 8*c* due to the effect of the repulsive magnetic field.

The developer that is conveyed by the inclined screw 8*d* contains the developer that has been collected from the developing roller 8*a*, and this developer is contributed to development in the development area, so that the toner concentration is lowered. The developing device 8 includes a toner concentration sensor for detecting the toner concentration of the developer to be conveyed by the inclined screw 8*d*.

Based on detection results obtained by the toner concentration sensor, a controller 300 outputs a replenishment operation signal for replenishing the toner to the developer that is conveyed by the inclined screw 8*d*, as required.

A toner cartridge 9 is disposed above the developing device 8 and includes a rotary shaft 9*a*, toner stirring members 9*b*, and a toner replenishment member 9*c*, as illustrated in FIG. 2. The toner cartridge 9 stirs and agitates the toner contained therein with the toner stirring members 9*b* fixed to the rotary shaft 9*a*. Further, the toner replenishment member 9*c* is driven to rotate according to the replenishment operation signal outputted from the controller 300. With this operation, the toner in an amount corresponding to a rotation amount of the toner replenishment member 9*c* is replenished to the inclined screw 8*d* of the developing device 8.

The toner image formed on the photoconductor 1 as a result of the development enters the transfer nip region where the photoconductor 1 and the transfer roller 10 that functions as a transfer device contact each other as the photoconductor 1 rotates. A charging bias having the opposite polarity to the latent image electric potential of the photoconductor 1 is applied to the transfer roller 10. Accordingly, an electric field is formed in the transfer nip region.

As described above, the registration roller pair 49 conveys the sheet S toward the transfer nip region in synchronization with a timing at which the toner image formed on the photoconductor 1 is overlaid onto the sheet S in the transfer nip region. The toner image formed on the photoconductor 1 is transferred onto the sheet S that is closely contacted to the toner image in the transfer nip region due to the actions of the electric field in the transfer nip region and the nip pressure.

Residual toner that is not transferred onto the sheet S remains on the surface of the photoconductor 1 after having passed through the transfer nip region. The residual toner is scraped off from the surface of the photoconductor 1 by the cleaning blade 2 that is in contact with the photoconductor 1 and, thereafter, is transmitted toward an outside of a unit casing by the collection screw 3. The residual toner that is removed from the unit casing is transported to a waste toner bottle by a conveying device.

The surface of the photoconductor 1 that is cleaned by the cleaning blade 2 is electrically discharged by an electric discharging device. Thereafter, the surface of the photoconductor 1 is uniformly charged again by the charging roller 4.

Foreign materials such as toner additive agents and the toner that has not been removed by the cleaning blade 2 adhere to the charging roller 4 that is in contact with the surface of the photoconductor 1. These foreign materials are shifted to a cleaning roller 5 that is in contact with the charging roller 4. Thereafter, the foreign materials are scraped off from the surface of the cleaning roller 5 by a scraper 6 that is in contact with the cleaning roller 5. The foreign materials scraped off from the surface of the cleaning roller 5 fall onto the toner collection screw 3.

In FIG. 1, the sheet S that has passed through the transfer nip region formed by the photoconductor 1 and the transfer roller 10 contacting each other is conveyed to a fixing device 30. The fixing device 30 includes a fixing roller 30*a* and a pressure roller 30*b*. The fixing roller 30*a* includes a heat generating source such as a halogen lamp. The pressure roller 30*b* is pressed against the fixing roller 30*a*. The fixing roller 30*a* and the pressure roller 30*b* contacting each other form a fixing nip region. The toner image is fixed to the surface of the sheet S that is held in the fixing nip region due to application of heat and pressure. Thereafter, the sheet S that has passed through the fixing device 30 passes through a sheet discharging path 31. Then, the sheet S is held in a sheet discharging nip region of a sheet discharging roller pair 32.

The image forming apparatus 1000 according to this example can switch or change modes between a single side printing mode and a duplex printing mode. The image forming apparatus 1000 according to this example can switch or change modes between a single side printing mode and a duplex printing mode. In a case in which the single side printing mode is selected or in a case in which the duplex printing mode is selected when images have already been formed on both sides of the sheet S, the sheet discharging roller pair 32 is continuously driven to rotate in a forward direction. By so doing, the sheet S in the sheet discharging path 31 is discharged to an outside of the image forming apparatus 1000. The discharged sheet S is stacked in a stack portion provided on the upper surface of the apparatus body 50.

By contrast, when an image is formed on one side (i.e., a front face) of the sheet S in the duplex printing mode, the sheet discharging roller pair 32 is driven to reversely rotate at the timing when the end portion (e.g., the leading end) of the sheet S enters the sheet discharging nip region formed by the pair of the sheet discharging roller pair 32. At this time, a separating claw 47 that is disposed in the vicinity of an terminal end of the sheet discharging path 31 is activated to close the sheet discharging path 31 and open an entrance of a sheet reverse reentry path 48. The sheet S starts moving in a reverse direction to the sheet conveying direction as the sheet discharging roller pair 32 rotates reversely. Then, the sheet S is conveyed into the sheet reverse reentry path 48. Further, the sheet S is conveyed while being reversed upside down through the sheet reverse reentry path 48. The sheet S then travels through a sheet reentry path 60 that is disposed immediately above the sheet tray 100. After passing through the registration nip region of the registration roller pair 49 again, the sheet S is conveyed toward the transfer nip region. The toner image is transferred onto the other side (e.g., a reverse side) in the transfer nip region, the sheet S passes through the fixing device 30, the sheet discharging path 31, and the sheet discharging roller pair 32 to be discharged to the outside of the image forming apparatus 1000.

Figure 3:
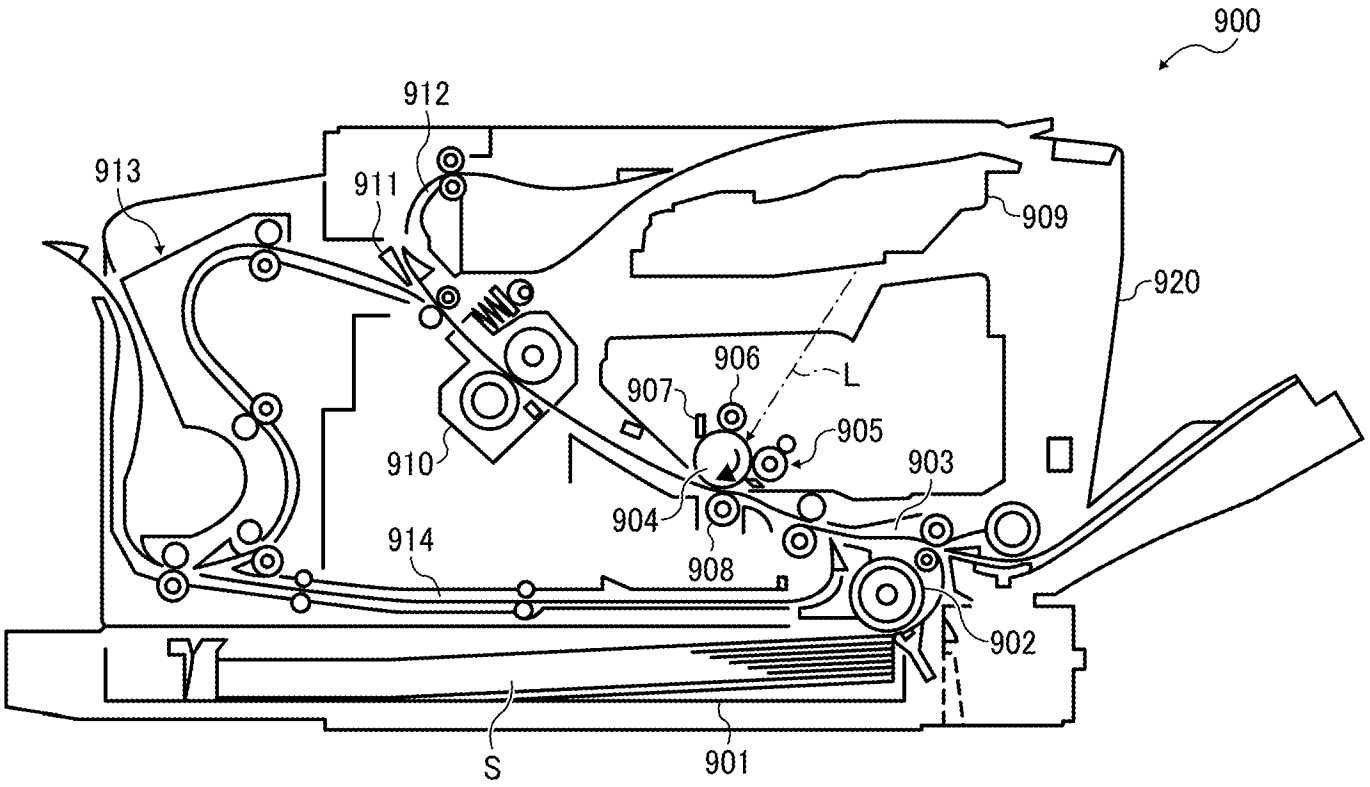
FIG. 3 is a schematic diagram illustrating a comparative image forming apparatus.
Figure 4:
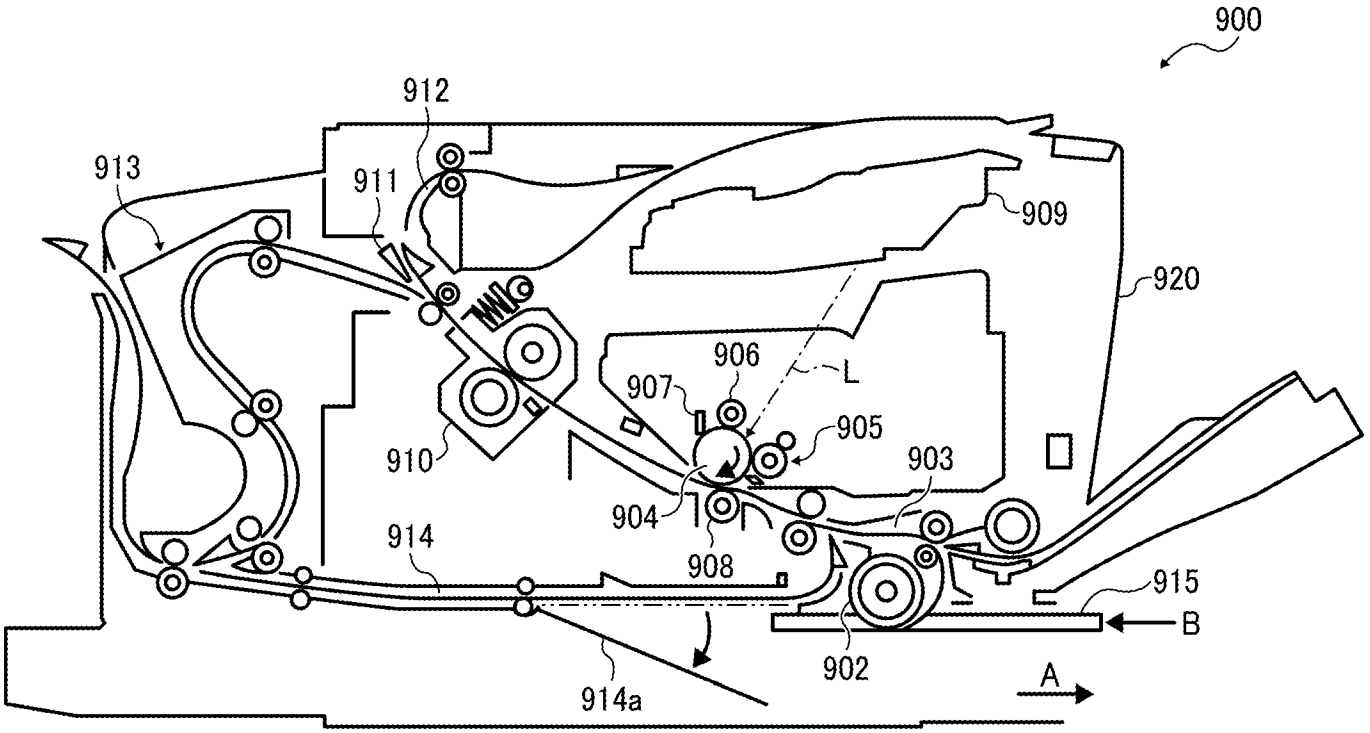
FIG. 4 is a diagram illustrating an inclining action of a reentry path bottom plate of the image forming apparatus of FIG. 3.

Now, a description is given of a sheet tray 970 provided to an image forming apparatus according to comparative examples, with FIGS. 3 and 4.

For example, FIG. 3 is a schematic diagram illustrating a comparative image forming apparatus 900.

As illustrated in FIG. 3, the comparative image forming apparatus 900 includes an image forming part 950, an apparatus body 920, a sheet tray 901, a sheet feeding path 903, a fixing device 910, a sheet discharging path 912, a sheet reversing device 913, and a sheet reentry path 914.

The image forming part 950 includes a photoconductor 904, a charger 906, an optical writing device 909, a developing device 905, a cleaning blade 907, and a transfer device 908.

In the image forming part 950, the charger 906 uniformly charges a surface of the photoconductor 904 that rotates in a clockwise direction in FIG. 3. Then, the optical writing device 909 emits a light beam L to irradiate the charged surface of the photoconductor 904, so that an electrostatic latent image is formed on the surface of the photoconductor 904. The developing device 905 develops the electrostatic latent image formed on the surface of the photoconductor 904 into a visible toner image. By so doing, the toner image is transferred onto a sheet S conveyed between the photoconductor 904 and the transfer device 908.

The sheet tray 901 is detachably attachable to the apparatus body 920 and contains the sheet S therein so as to supply the sheet S to the image forming part 950. The leading end of the sheet S contained in the sheet tray 901 is in contact with a sheet feed roller 902. As the sheet feed roller 902 rotates, the sheet S is fed to the sheet conveying path 903.

The sheet fed from the sheet tray 901 is conveyed to a transfer nip region formed between the photoconductor 904 and the transfer device 908 of the image forming part 950. After the toner image formed on the photoconductor 904 is transferred onto the sheet S in the transfer nip region, the sheet S is conveyed to the fixing device 910 where the toner image is fixed to the sheet S.

Residual toner that is not transferred onto the sheet S remains on the surface of the photoconductor 904 after having passed through the transfer nip region. The residual toner is scraped off from the surface of the photoconductor 904 by the cleaning blade 907 that is in contact with the photoconductor 904.

After passing through the fixing device 910, the sheet S reaches a position where a switching claw 911 is disposed. According to printing operations, the switching claw 911 changes its direction whether the sheet S is discharged to an outside of the image forming apparatus 900 via a sheet discharging path 912 or is conveyed to the sheet conveying path 903 again via a sheet reversing unit 913 and a sheet reentry path 914.

In a case in which the sheet is conveyed the sheet conveying path 903 again for duplex printing on a rear surface of the sheet S that already has an image on a front surface thereof, the sheet S having a printed image on the front surface thereof is reversed upside down in the sheet reversing unit 913. Then, the sheet S is conveyed via the sheet reentry path 914 that is disposed immediately above the sheet tray 901 to the sheet conveying path 903. Then, when the sheet S passes through the image forming part 950, a toner image is formed on the rear surface of the sheet S. The toner image formed on the rear surface on the sheet S is fixed to the sheet S in the fixing device 910. Accordingly, the toner images are formed on both surfaces of the sheet S.

Next, a description is given of the detailed configuration of the image forming apparatus 1000.

Figure 5:
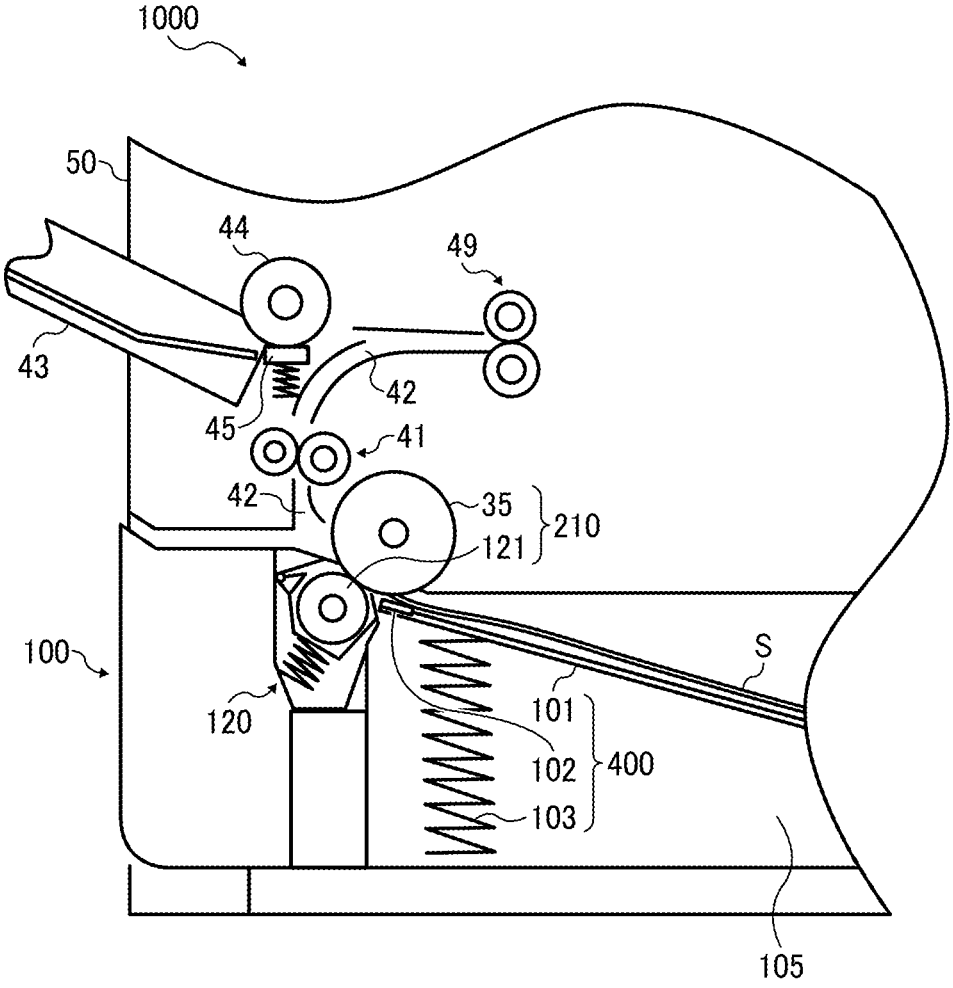
FIG. 5 is a partial enlarged view illustrating a lower part of the image forming apparatus of FIG. 1.

FIG. 5 is a partial enlarged view illustrating a lower part of the image forming apparatus 1000 of FIG. 1.

As illustrated in FIG. 5, the sheet tray 100 accommodates the sheet bundle of the multiple sheets S loaded on a movable bottom plate 101. The movable bottom plate 101 is biased toward the sheet feed roller 35 by a bottom plate spring 103. A bottom plate pad 102 that is an elastic member is fixed at the leading end portion of the movable bottom plate 101. The leading end portion of the sheet bundle is pressed toward the sheet feed roller 35 by the force exerted by the bottom plate spring 103 in a state in which the leading end portion of the sheet bundle is sandwiched between the bottom plate pad 102 and the sheet feed roller 35.

Figure 12:
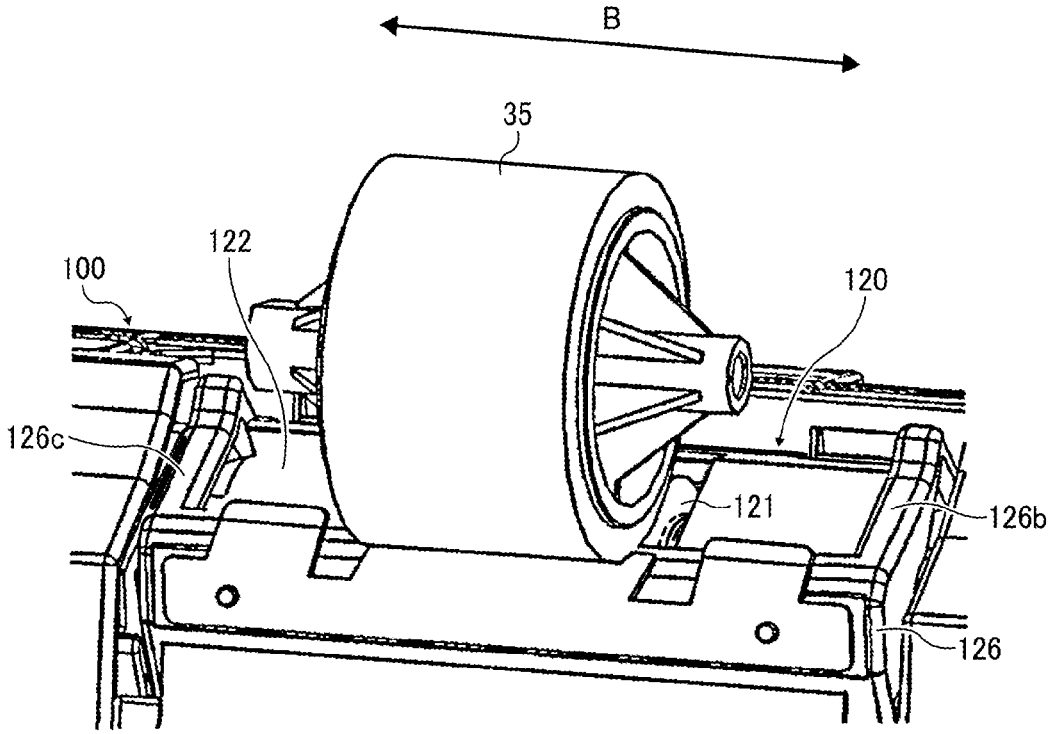
FIG. 12 is a partial perspective view illustrating the separation roller unit of the sheet tray installed in the apparatus body and a sheet feeding roller fixedly attached in the apparatus body.

The sheet feed roller 35 has a rotary shaft 35*a* (FIG. 12).

As the sheet feed roller 35 rotates, an uppermost sheet S placed on top of the sheet bundle is fed from the movable bottom plate 101. Then, the uppermost sheet S enters the sheet separation nip region formed by contact of the sheet feed roller 35 and a sheet separating roller 121 included in a separation roller unit 120. The sheet feed roller 35 that functions as a sheet feeding body and the sheet separating roller 121 that functions as a sheet separating body form a sheet separating part 210 that functions as a sheet separating feeder.

In the image forming apparatus 1000, as described above, the sheets S are fed from the sheet tray 100 as the sheet feed roller 35 is driven in a state in which the sheet S is pressed against the sheet feed roller 35 by a pressing device 400 including the movable bottom plate 101, the bottom plate pad 102, and the bottom plate spring 103. This configuration can achieve cost reduction by not providing a pickup roller for the sheet tray 100. That is, the image forming apparatus 1000 reduces the cost by employing a pickup-less structure.

Generally, a rotation driving force is applied to the sheet separating roller 121 for moving the surface of the sheet separating roller 121 in a direction opposite to the direction of rotation of the sheet feed roller 35, as required. However, in the image forming apparatus 1000 according to the present example, such a rotation driving force is not applied to the sheet separating roller 121. The sheet separating roller 121 rotates by following rotation of the sheet feed roller 35 and movement of the sheets S in the sheet separation nip region.

Figure 13:
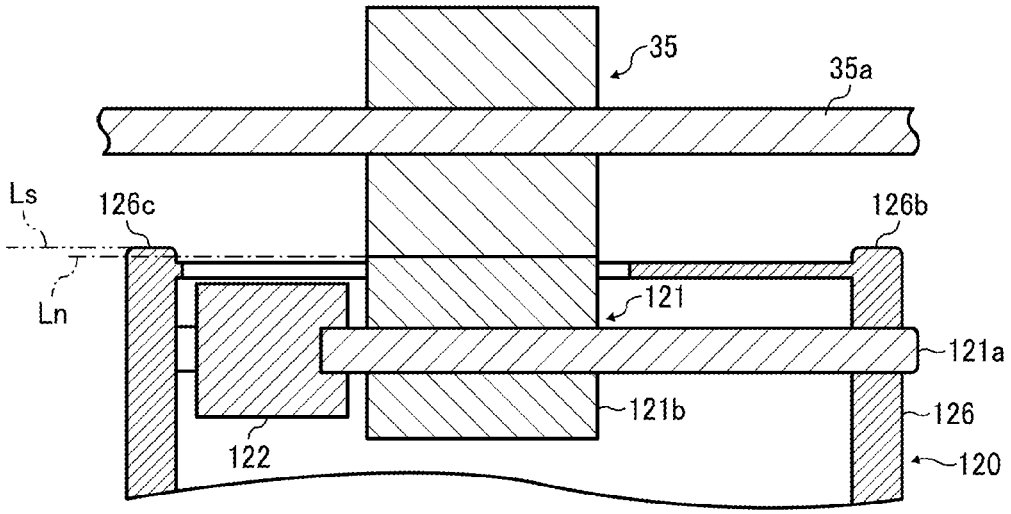
FIG. 13 is a vertical cross sectional view illustrating the sheet feeding roller and the separation roller unit of FIG. 11.

The sheet separating roller 121 has a rotary shaft 121*a* (see FIG. 13) and a cylindrical roller part 121*b* (FIG. 13). One end of the rotary shaft 121*a* of the sheet separating roller 121 is rotatably supported by a torque limiter 122 (see FIG. 12). When the sheet S is not in the sheet separation nip region, the sheet separating roller 121 contacts the sheet feed roller 35 directly. As the sheet feed roller 35 rotates in this state, a relatively large driving force is applied from the sheet feed roller 35 to the sheet separating roller 121. According to this configuration and operation, a torque of rotation of the sheet separating roller 121 exceeds a given threshold of the torque of rotation thereof, so that the torque limiter 122 causes the sheet separating roller 121 to rotate. That is, when the sheet S is not entered in the sheet separation nip region, the sheet separating roller 121 rotates with the sheet feed roller 35.

Further, when a single sheet S enters the sheet separation nip region, there are no sheets other than the single sheet S between the sheet separating roller 121 and the sheet feed roller 35. In this state, if the sheet feed roller 35 rotates, the sheet feed roller 35 exerts a strong conveying force on the sheet S, and therefore the sheet S moves in the sheet feeding direction. At the same time, the sheet feed roller 35 exerts a relatively strong driving force on the sheet separating roller 121 via the sheet S interposed therebetween. Consequently, the torque for rotating the sheet separating roller 121 with the sheet feed roller 35 exceeds a predetermined threshold value, so that the torque limiter permits the sheet separating roller 121 to rotate with the sheet feed roller 35. Specifically, when the single sheet S exists in the sheet separation nip region, the sheet separating roller 121 rotates with the sheet feed roller 35.

By contrast, it is assumed that two or more sheets S enter the sheet separation nip region in a form of layers due to multi feed. In this case, the sheet feed roller 35 exerts a relatively strong conveying force on the uppermost sheet S that is in direct contact with the sheet feed roller 35 in the sheet separation nip region, and therefore the uppermost sheet S is conveyed in the sheet feeding direction.

Further, the remaining sheets S other than the uppermost sheet S are pressed in the sheet separation nip region, and therefore are subjected to a conveyance resistance. This conveyance resistance exceeds a frictional resistance between the uppermost sheet S and a subsequent sheet S, that is, a second sheet S. Accordingly, a slip is induced between the uppermost sheet S and the subsequent sheet S. Due to this slip, the torque for causing the sheet separating roller 121 to rotate with the sheet feed roller 35 comes to be equal to or smaller than the predetermined threshold value, so that the torque limiter stops the sheet separating roller 121 from rotating with the sheet feed roller 35. This operation further increases the conveyance resistance exerted on the second and other subsequent sheets S. As a result, movement of the second and other subsequent sheets S is stopped. Thus, the sheet separating roller 121 exerts the conveyance resistance on the multiple sheets S and separates the uppermost sheet S from the other sheets S of the sheet bundle.

The image forming apparatus 1000 having this configuration separates the sheets S in the sheet separation nip region without exerting a rotation driving force from a motor on the sheet separating roller 121. With this separation of the sheet S in the sheet separation nip region, a driving transmission device for transmitting driving to the sheet separating roller 121 is eliminated, thereby enabling cost reduction.

Figure 6:
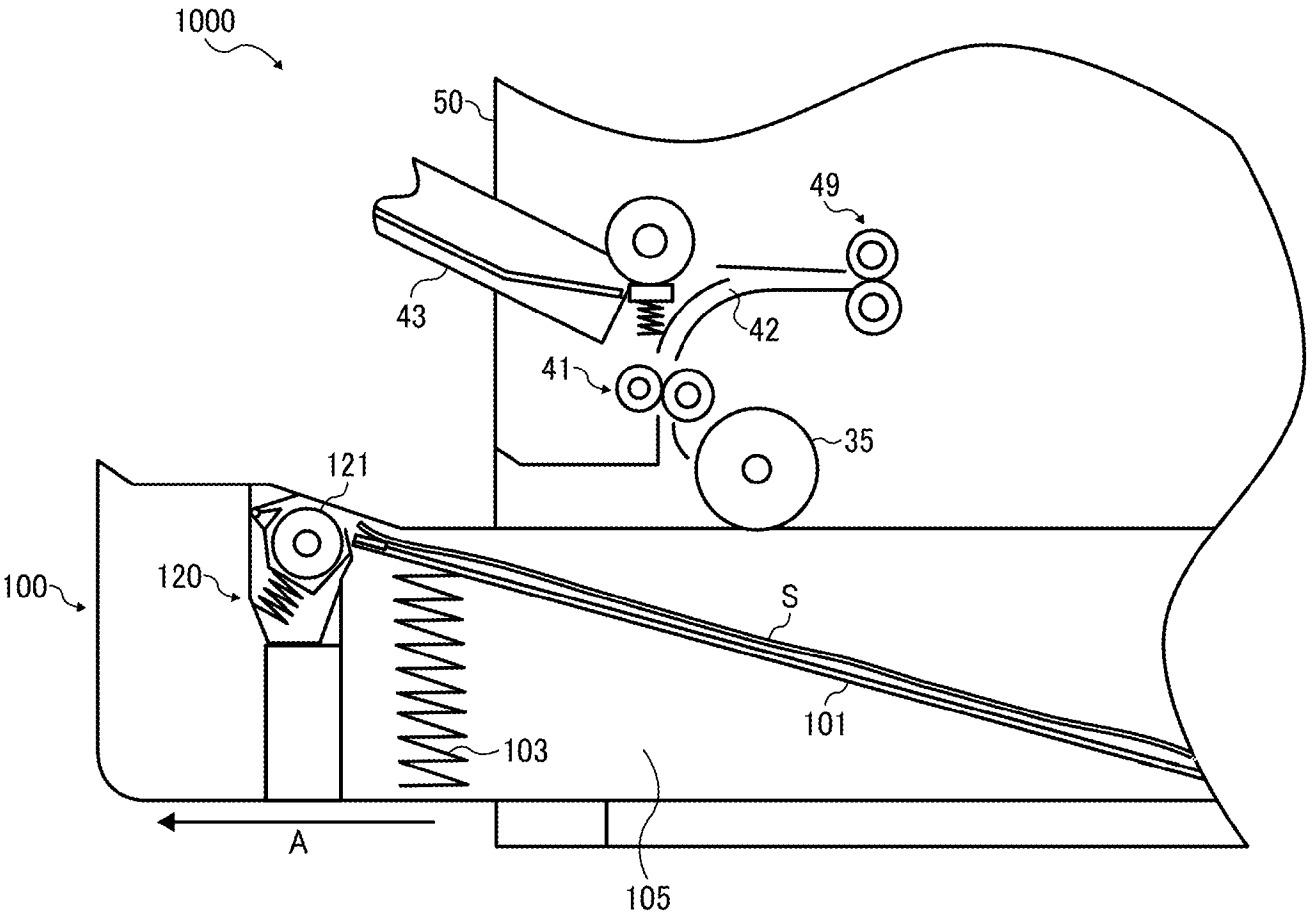
FIG. 6 is a partial enlarged view illustrating a sheet tray that is being pulled out from an apparatus body of the image forming apparatus body of FIG. 1.

FIG. 6 is a partial enlarged view illustrating the sheet tray 100 that is being pulled out from the apparatus body 50 of the image forming apparatus 1000.

As illustrated in FIG. 6, the image forming apparatus 1000 has the configuration in which the sheet separating roller 121 is supported by the sheet tray 100 and is disposed detachably attachable to the apparatus body 50 together with the sheet tray 100. With this configuration, the sheet tray 100 can be detachably attached to the apparatus body 50 by sliding not in an axial direction of rotation of a roller such as the sheet feed roller 35 and the sheet separating roller 121 but in a left-to-right direction in FIG. 6. Since the sheet separating roller 121 moves together with the sheet tray 100, the sheet separating roller 121 does not obstruct sliding and moving of the sheet tray 100 in a direction indicated by arrow A along the left-to-right direction in FIG. 6. Hereinafter, the axial direction of rotation of a roller such as the sheet feed roller 35 and the sheet separating roller 121 is referred to as a "roller axis direction".

If a paper jam occurs in a state in which the sheet S is being held in the sheet separation nip region, a user slides and moves the sheet tray 100 in the direction A in FIG. 6 to pull out the jammed sheet S from the apparatus body 50. Then, the sheet separating roller 121 is taken out therefrom together with the sheet tray 100, and therefore the sheet separation nip region is eliminated. However, the jammed sheet S is held in a sheet conveyance nip region formed by the first conveying roller pair 41, and, therefore remains in the apparatus body 50.

Since the sheet tray 100 is pulled out from apparatus body 50, space is generated within apparatus body 50. The space is largely open in the direction A in FIG. 6, which is a sheet tray detaching direction. The user can easily and visually recognize the jammed sheet toward the surface thereof through this opening.

Further, the user can pull out the jammed sheet from the sheet conveyance nip region formed by the first conveying roller pair 41 while grasping the opposite end portions of the jammed sheet in the roller axis direction with his/her both hands inserted through the opening. At this time, respective pulling forces are exerted on the opposite end portions of the jammed sheet. By so doing, concentrations of the pulling forces are restrained and occurrence of tears of the jammed sheet can be substantially avoided in comparison with cases where the jammed sheet is grasped at one end portion thereof.

Accordingly, the image forming apparatus 1000 can restrain tears of jammed sheets during eliminating paper jams.

It is to be noted that the sheet tray pull-out direction of the image forming apparatus 1000 from the apparatus body 50 (i.e., the direction A in FIG. 6) is a direction in which the sheet tray 100 is moved from the side close to a sheet containing unit 105 toward the side close to the separation roller unit 120, as illustrated in FIG. 6.

Figure 7:
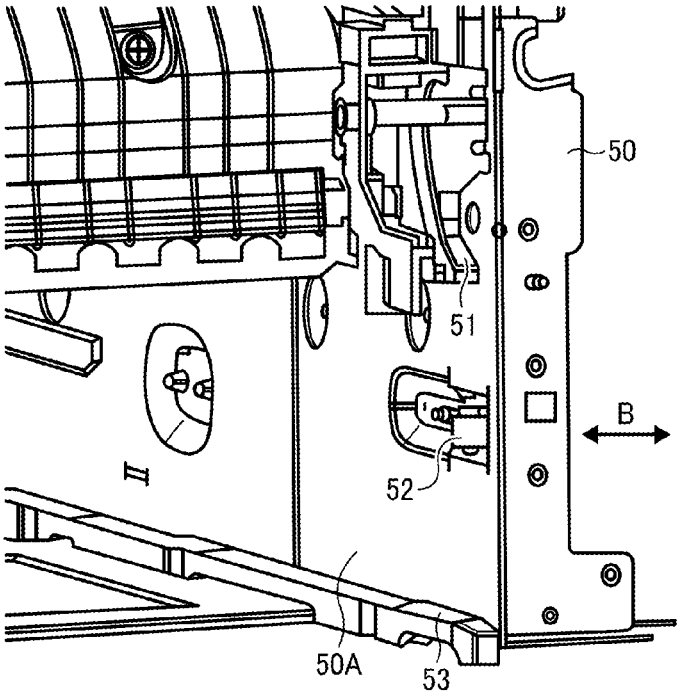
FIG. 7 is a partial perspective view illustrating the apparatus body with space therein due to withdrawal of the sheet tray of FIG. 6.

FIG. 7 is a partial perspective view illustrating the apparatus body 50 with space therein due to withdrawal of the sheet tray 100. A direction indicated by arrow B is the roller axis direction of the sheet feed roller 35. FIG. 7 illustrates one end portion of the sheet feed roller 35 in the roller axis direction in the apparatus body 50.

A rail 53 is disposed at one end of the identical roller axis direction of the sheet feed roller 35 on a bottom part of the apparatus body 50. The rail 53 extends in a sheet tray detaching/attaching direction in which the sheet tray 100 is detached and attached with respect to the apparatus body 50 of the image forming apparatus 1000. It is to be noted that another rail that is identical to the rail 53 is also disposed at the other end of the identical roller axis direction of the sheet feed roller 35 on the bottom part of the apparatus body 50.

The sheet tray 100 slides in a direction in which the rails 53 extend while being placed on the rails 53. By so doing, the sheet tray 100 can be detached and attached with respect to the apparatus body 50. Further, by placing the sheet tray 100 on the rail 53 and the rail disposed at the other end of the sheet feed roller 35 on the bottom part of the apparatus body 50, the height of the sheet tray 100 in the apparatus body 50 can be positioned.

In FIG. 7, a member that extends vertically in the apparatus body 50 is a right side plate 50A of the apparatus body 50. Though not illustrated in FIG. 7, a left side plate of the apparatus body 50 is also disposed on the opposite end to the right side plate 50A in the identical roller axis direction. A positioning stopper 51 is mounted on an inner wall of the right side plate 50A. The positioning stopper 51 positions the sheet tray 100 in the apparatus body 50 in the sheet tray detaching/attaching direction. An identical positioning stopper is mounted on an inner wall of the left side plate of the apparatus body 50. The sheet tray 100 includes a contact part 108 (refer to FIG. 8). When the sheet tray 100 is placed on the rails 53 and inserted into the apparatus body 50, the sheet tray 100 abuts the contact part 108 against the positioning stopper 51. By so doing, the sheet tray 100 is positioned in the sheet tray detaching/attaching direction.

When the contact part 108 of the sheet tray 100 is simply abutted against the positioning stopper 51, if any impact or force is applied to the apparatus body 50, the sheet tray 100 is likely to be pushed in a tray removing direction.

To address the inconvenience, an engaging member 52 is disposed on an inner wall of a right side plate of the apparatus body 50 to be movable in the identical roller axis direction (as indicated by arrow B in FIG. 7). The engaging member 52 is biased by a spring, so that the engaging member 52 is restricted at a position projecting from the inner wall of the right side plate of the apparatus body 50 toward an inside of the apparatus body 50. As illustrated in FIG. 7, the engaging member 52 has a tapered portion. Even though FIG. 7 illustrates a single engaging member 52 thereon, another engaging member 52 is disposed on an inner wall of a left side plate of the apparatus body 50 that is identical to the engaging member 52 on the inner wall of the right side plate thereof.

Figure 8:
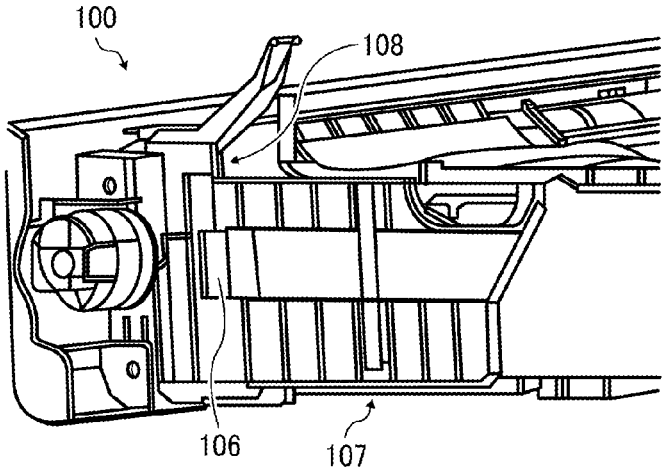
FIG. 8 is a partial perspective view illustrating the sheet tray viewed from a rear side thereof.

FIG. 8 is a perspective view illustrating a part of the sheet tray 100 viewed from a rear side thereof.

A tray fall prevention projection 106 is provided on an outer face of a right side plate of the sheet tray 100. A positioning part 107 is provided on an outer face of a bottom wall of the sheet tray 100. By putting the positioning part 107 on the rail 53 provided on the lower part of the apparatus body 50 illustrated in FIG. 7, the sheet tray 100 is positioned in the vertical direction.

As the sheet tray 100 is inserted into the inside of the apparatus body 50 on the rails 53 toward the rear side of the image forming apparatus 1000, the tray fall prevention projection 106 of the sheet tray 100 slides on the tapered portion of the engaging member 52 of the apparatus body 50. Along with sliding of the sheet tray 100, the engaging member 52 is pressed toward the outside of the side plate, and therefore a projection amount of the tray fall prevention projection 106 from the inner face of the side plate is reduced.

Immediately before the sheet tray 100 abuts the contact part 108 against the positioning stopper 51 of the apparatus body 50 to be positioned, the tray fall prevention projection 106 of the sheet tray 100 separates from the engaging member 52 of the apparatus body 50. Then, the engaging member 52 that has reduced an amount of projection from the inner wall of the side plate (e.g., the right side plate 50A) projects instantly to a position illustrated in FIG. 7. By causing a projecting part of the engaging member 52 to contact with a back surface of the tray fall prevention projection 106, the sheet tray 100 is prevented from moving in the sheet tray detaching direction, that is, is restrained to a regular position. As a result, even if a sudden and unexpected impact is applied to the apparatus body 50, the sheet tray 100 can be correctly positioned and restrained in the sheet tray detaching/attaching direction.

It is to be noted that the engaging member 52 further has a taper having a sharp angle on a rear side thereof in FIG. 8.

Due to the tray fall prevention projection 106 of the sheet tray 100, a force such as an impact cannot pull down the engaging member 52. However, when the user pulls out the sheet tray 100 from the apparatus body 50 with a force greater than the impact force, the tray fall prevention projection 106 of the sheet tray 100 pushes down the engaging member 52 while sliding with a great force on the taper formed on the rear side of the engaging member 52. Consequently, the user can pull out the sheet tray 100 from the apparatus body 50.

As described above, by performing vertical positioning and horizontal positioning of insertion and removal of the sheet tray 100, the sheet separating roller 121 that is supported by the sheet tray 100 is positioned in the apparatus body 50 precisely.

It is to be noted that, in order to position the sheet tray 100 in a vertical direction more precisely, a positioning stopper such as the positioning stopper 51 on each of two side plates (i.e., the right side plate 50A and the left side plate) of the apparatus body 50 includes a rail part and a fine projection that slightly projects from a surface of the rail part. A fine positioning part provided to the sheet tray 100 runs aground to the fine projection. At the same time, a contact part (e.g., the contact part 108) of the sheet tray 100 is caused to abut against a pressed part of the positioning stopper 51.

Figure 9:
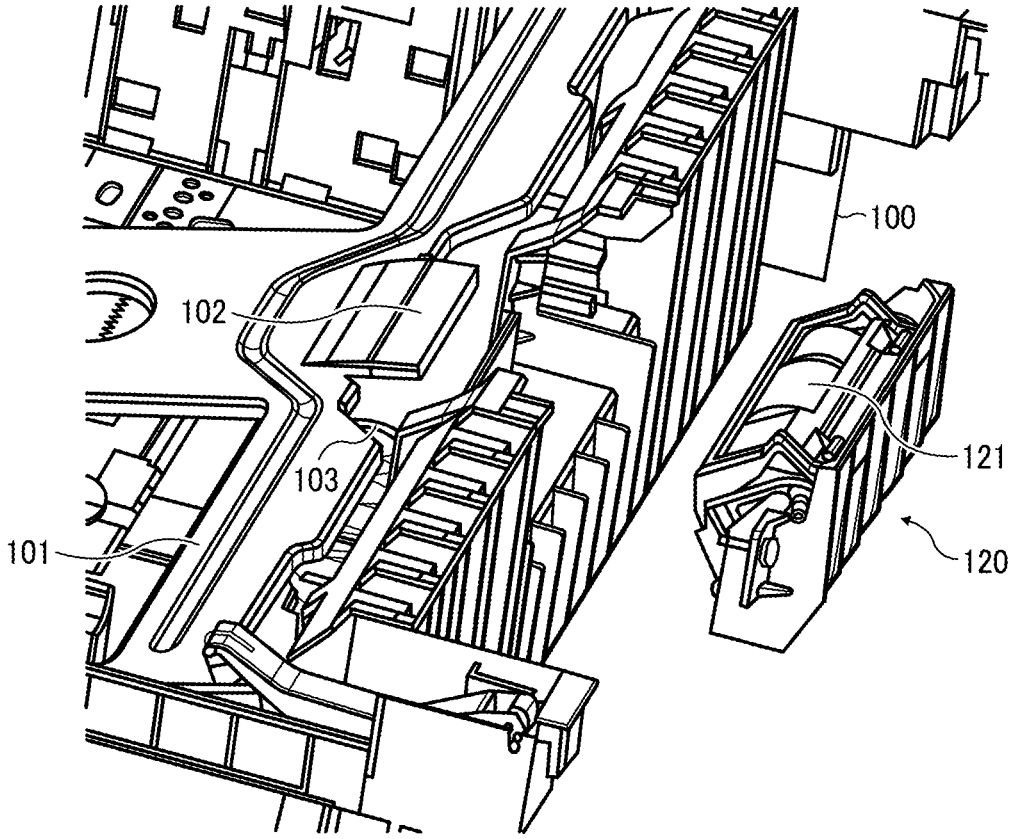
FIG. 9 is a partial perspective view illustrating the sheet tray viewed from a front side thereof.

FIG. 9 is a partial perspective view illustrating the sheet tray 100, viewed from a front side thereof. In FIG. 9, a front cover, which is a cover provided with a pulling-out handle, in the sheet tray 100 is not illustrated, for convenience.

As illustrated in FIG. 9, the sheet separating roller 121 that functions as a sheet separating body is structured to be included in the separation roller unit 120 together with in cooperation with other several components as described below. The separation roller unit 120 is integrally attached and detached with respect to a receiving portion in the sheet tray 100. Thus, by making the sheet separating roller 121 into a unit, components can be standardized with other types of image forming apparatuses. Accordingly, a cost reduction can be achieved. Specifically, sheet trays in other types of image forming apparatuses having different specifications from the image forming apparatus 1000 according to this example are also adapted to have the same configuration as the sheet tray 100 in the image forming apparatus 1000. However, such sheet trays in other types of image forming apparatuses are adapted to accommodate different numbers of sheets S from the sheet tray 100 in the image forming apparatus 1000. Therefore, the sheet trays in image forming apparatuses of different types have different thicknesses thereof. Even such sheet trays having different specifications as described above are adapted to include the separation roller unit 120 having completely the identical specifications to be attached and detached. Accordingly, standardization to use common components is achieved.

Figure 10:
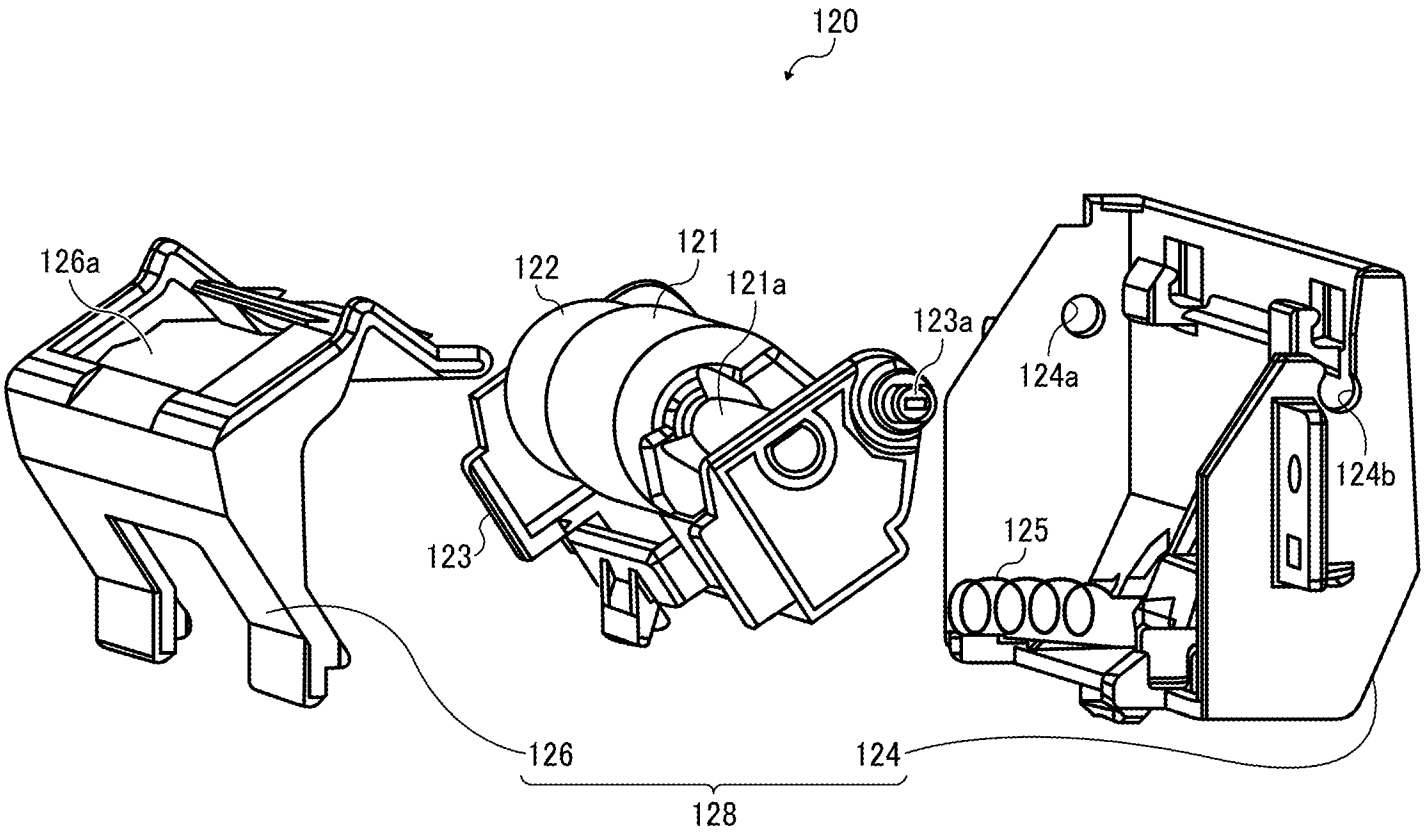
FIG. 10 is an exploded perspective view illustrating a separation roller unit included in the sheet tray.

FIG. 10 is an exploded perspective view illustrating the separation roller unit 120.

As illustrated in FIG. 10, the separation roller unit 120 includes the sheet separating roller 121, the torque limiter 122, a swing holder 123, a coil spring 125, a cover unit 128 including a top cover 126 and a base cover 124, and the like.

The one end of the rotary shaft 121*a* of the sheet separating roller 121 is rotatably supported by and connected to the torque limiter 122. The functions of the torque limiter 122 are previously described above. The torque limiter 122 and the sheet separating roller 121 are held by the swing holder 123. The other side of the torque limiter 122, which is an opposite side thereof facing and being connected to the rotary shaft 121*a* of the sheet separating roller 121, is fixedly attached to a right side plate of the swing holder 123. Further, the other end of the rotary shaft 121*a* of the sheet separating roller 121 is rotatably supported by a left side plate of the swing holder 123.

Accordingly, the swing holder 123 that holds the torque limiter 122 and the sheet separating roller 121 is contained in the cover unit 128 that functions as a containing device including the top cover 126 and the base cover 124. Specifically, respective swing shafts 123*a* are provided along a coaxial line on both the right side plate and the left side plate of the swing holder 123. The base cover 124 has a shaft hole 124*a* and a cutout 124*b*. One of the swing shafts 123*a* is engaged with the shaft hole 124*a* and the other of the swing shafts 123*a* is engaged with the cutout 124*b*. Accordingly, the swing holder 123 is supported by the base cover 124 so as to rotate about the swing shafts 123*a*.

The top cover 126 fits to the base cover 124 from above. In this state, a circumferential surface of the sheet separating roller 121 disposed inside the cover unit 128 is exposed through an opening 126*a* of the top cover 126 (see FIG. 9). The base cover 124 further includes the coil spring 125 that functions as a spring or a biasing member. The coil spring 125 is fixed to the base cover 124, so that the coil spring 125 biases the swing holder 123 centering the swing shaft 123*a* from the base cover 124 toward the top cover 126. When the separation roller unit 120 is not attached to the sheet tray 100 as illustrated in FIG. 9, the circumferential surface of the sheet separating roller 121 contacts a rear side of the top cover 126.

In the image forming apparatus 1000 according to this example, a right end face of the apparatus body 50 in FIG. 1 is a front side of the image forming apparatus 1000 and a left end face of the apparatus body 50 is the rear side of the image forming apparatus 1000. A far side or an inward side in a direction perpendicular to a sheet face of FIG. 1 is a right side of the apparatus body 50 and a near side or an outward side in the direction perpendicular to the sheet face of FIG. 1 is a left side thereof. Specifically, when detaching the sheet tray 100 that is placed inside the apparatus body 50 of the image forming apparatus 1000, a user pulls out the sheet tray 100 to the front side of the apparatus body 50. By contrast, when attaching the sheet tray 100, the user inserts the sheet tray 100 into the apparatus body 50 toward the rear side of the image forming apparatus 1000. Hereinafter, a direction from the rear side to the front side of the image forming apparatus 1000 along a tray attaching/detaching direction is referred to as a "front side direction" and an opposite direction to the front side direction is referred to as a "rear side direction".

Figure 11:
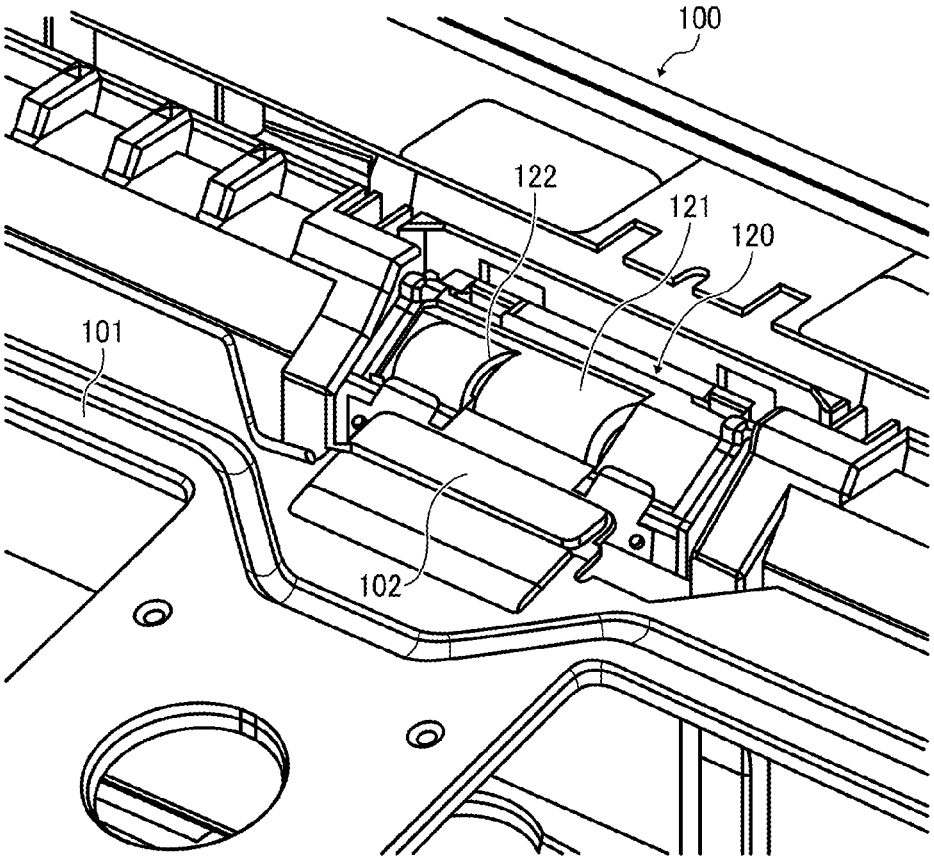
FIG. 11 is a partial perspective view illustrating a front end part of the sheet tray.

As illustrated in FIG. 11, when the separation roller unit 120 is attached to an attaching part of the sheet tray 100, the bottom plate pad 102 that is fixedly attached to a leading end of the movable bottom plate 101 of the sheet tray 100 comes in the vicinity of the rear side of the sheet separating roller 121. As described above, the bottom plate pad 102 presses the sheet S accommodated in the sheet tray 100 toward the sheet feed roller 35.

FIG. 12 is a partial perspective view illustrating a part of the separation roller unit 120 of the sheet tray 100 attached to a housing of the apparatus body 50 and the sheet feed roller 35 fixedly provided to the housing of the apparatus body 50.

In the process of attaching the sheet tray 100 to the apparatus body 50 by slidably inserting the sheet tray 100 into the apparatus body 50, the sheet feed roller 35 that is fixedly provided in the apparatus body 50 contacts the sheet separating roller 121 that is held by the sheet tray 100. Specifically, part of the outer circumferential surface of the sheet separating roller 121 before contacting the sheet feed roller 35 projects more outwardly than the top cover 126 through the opening 126*a* (FIG. 10) of the top cover 126 of the separation roller unit 120. In this state, the sheet separating roller 121 is pushed into the apparatus body 50 together with the sheet tray 100, and eventually abuts against the outer circumferential surface of the sheet feed roller 35 that is fixedly provided to the apparatus body 50.

As the sheet tray 100 is further pushed and inserted into the apparatus body 50, the sheet separating roller 121 is pushed back by the sheet feed roller 35. Due to the push-back force of the sheet feed roller 35, the swing holder 123 starts to rotate about the swing shaft 123*a* from the top cover 126 toward the base cover 124 against the biasing force of the coil spring 125. By so doing, the sheet separating roller 121 gradually rotates about the swing shaft 123*a* from the sheet feed roller 35 toward the sheet separating roller 121. Accordingly, the contact part of both rollers gradually moves from the sheet feed roller 35 toward the sheet separating roller 121. When the sheet tray 100 is pushed to a regular attachment position, the sheet separating roller 121 is detached from the rear side of the top cover 126 completely.

When a sheet having a large rigidity such as a thick paper is used as the sheet S, it is likely that the large rigidity of the sheet S that is held in the sheet separation nip region applies a force to the sheet separating roller 121 to separate from the sheet feed roller 35. This application of the force to separate from the sheet feed roller 35 causes misfeed of the sheet S due to the force. Specifically, due to the force, the swing holder 123 that is biased by the coil spring 125 as illustrated in FIG. 10 toward the sheet feed roller 35 rotates about the swing shaft 123*a* in a direction to separate from the sheet feed roller 35, so as to cause the sheet separating roller 121 to separate largely from the sheet feed roller 35. With this operation, a sheet conveying force applied by the surface movement of the sheet feed roller 35 is not transmitted to the sheet S, which causes misfeed of the sheet S. Hereinafter, this misfeed is referred to as "misfeed due to pressing back".

FIG. 13 illustrates a vertical cross sectional view of the sheet feed roller 35 and the separation roller unit 120 of FIG. 12.

The image forming apparatus 1000 further includes a projection 126*b* and a projection 126*c* in the vicinity of the opening 126*a* on the top cover 126 of the separation roller unit 120, as illustrated in FIG. 12. The projections 126*b* and 126*c* are aligned in the roller axis direction or rotation of the cylindrical roller part 121*b* of the sheet separating roller 121.

In FIG. 13, a dot-dashed line with a reference sign "Ln" indicates an extension of a straight line from the sheet separation nip region and another dot-dashed line with a reference sign "Ls" indicates an extension of a straight line from respective surfaces of the projections 126*b* and 126*c*.

The projection 126*b* is aligned facing an end surface (i.e., the right end surface in FIG. 13) in the roller axis direction or rotation of the cylindrical roller part 121*b* of the sheet separating roller 121 and projects toward the sheet feed roller 35 than the sheet separation nip region in the apparatus body 50. That is, the projection 126*b* is disposed at a position at one end of the rotary shaft 121*a* of the sheet separating roller 121 from the cylindrical roller part 121*b* in the roller axis direction of the rotary shaft 121*a* thereof and projecting beyond the sheet separation nip region toward the sheet feed roller 35 in the apparatus body 50.

Further, the projection 126*c* is aligned facing an opposite end surface (i.e., the left end surface in FIG. 13) in the roller axis direction or rotation of the roller part 121*b* of the sheet separating roller 121 and projects toward the sheet feed roller 35 than the sheet separation nip region in the apparatus body 50. That is, the projection 126*c* is disposed at a position at an opposite end to the one end of the rotary shaft 121*a* of the sheet separating roller 121 from the cylindrical rotary shaft 121*a* in the roller axis direction and projecting beyond the sheet separation nip region toward the sheet feed roller 35 in the apparatus body 50.

Figure 14:
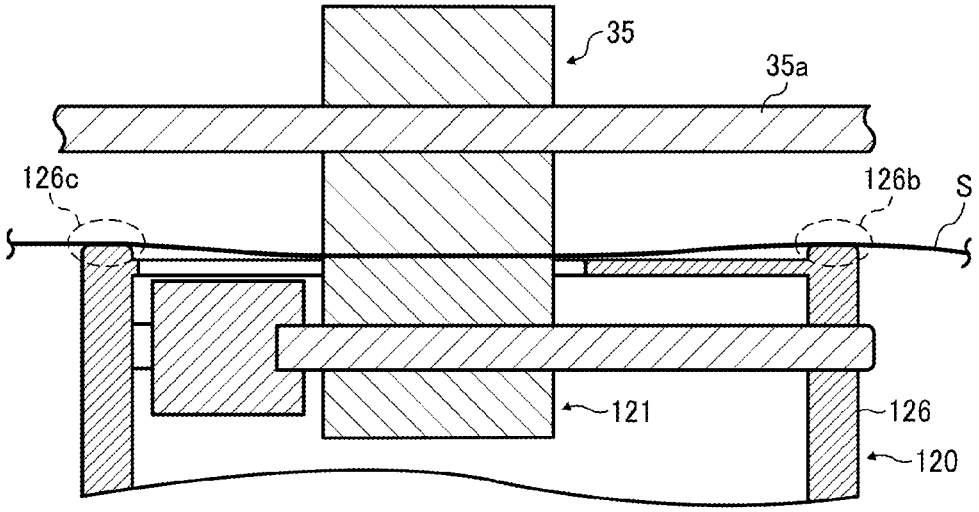
FIG. 14 is a vertical cross sectional view illustrating a state in which the sheet feeding roller and the sheet separating roller unit hold a sheet having a high rigidity in a sheet separation nip region formed therebetween.

As illustrated in FIG. 14, when the sheet S having a large rigidity is sandwiched in the sheet separation nip region, the sheet S becomes to have two slightly warping contact areas thereon in the entire region of the sheet S in the roller axis direction of the sheet S. Specifically, the sheet S slightly warps at a contact area contacting with the projection 126*b* and at another contact area contacting with the projection 126*c*. More specifically, the contact areas of the sheet S warp more toward the sheet separation nip region on the side of the sheet separating roller 121 than respective surfaces of the contact areas. Since the sheet S illustrated in FIG. 14 has a large rigidity, the sheet S attempts to eliminate the warp with a restoring force that is exerted by the sheet S. Therefore, the sheet S does not apply the force to separate the sheet separating roller 121 from the sheet feed roller 35. Accordingly, occurrence of misfeed due to pressing back that is caused by which the sheet S having a large rigidity applies the above-described force to the sheet separating roller 121 in the sheet separation nip region can be prevented.

Next, a description is given of a detailed configuration of the image forming apparatus 1000.

Figure 15:
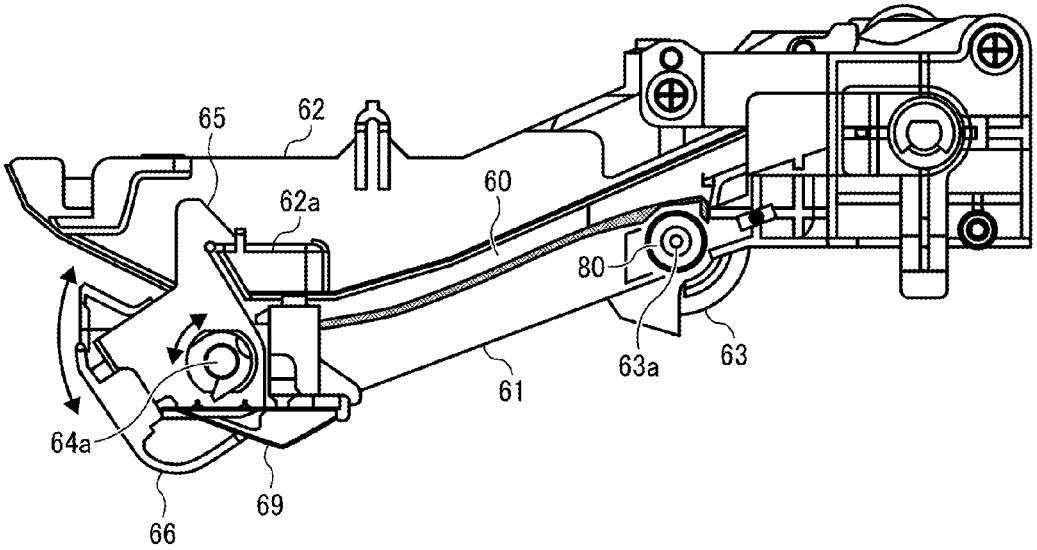
FIG. 15 is a side view illustrating a reentry path upper plate and a reentry path bottom plate forming part of the reentry path of the image forming apparatus of FIG. 1.

FIG. 15 is a side view illustrating a reentry path upper plate 62 and a reentry path bottom plate 61 (see FIG. 1) forming a part of the reentry path 60 of the image forming apparatus 1000 illustrated in FIG. 1.

As illustrated in FIG. 15, the sheet reentry path 60 is defined by the reentry path upper plate 62 and the reentry path bottom plate 61. The reentry path bottom plate 61 is disposed immediately below and facing the reentry path upper plate 62 with a given gap. The sheet S is conveyed in the sheet reentry path 60 from the right side to the left side of FIG. 15. The reentry path upper plate 62 is fixedly attached to the apparatus body 50.

A first lower reentry roller 63 is rotatably supported by a frame of the apparatus body 50. A first upper reentry roller is disposed above the first lower reentry roller 63 behind the frame of the apparatus body 50 in FIG. 15. The first upper reentry roller contacts the first lower reentry roller 63 to form a first reentry nip region. The sheet S entered and held in the first reentry nip region is conveyed from the right side to the left side of FIG. 15 in the sheet reentry path 60.

The reentry path bottom plate 61 that forms a floor of the sheet reentry path 60. A right end of the reentry path bottom plate 61 in FIG. 15 is rotatably supported by a rotary shaft 63*a* of the first roller reentry roller 63. FIG. 15 illustrates a state in which a near end of the reentry path bottom plate 61 in a direction perpendicular to the drawing is rotatably supported by the rotary shaft 63*a* of the first lower reentry roller 63. Similarly, a far end of the reentry path bottom late 61 is rotatably supported by the rotary shaft 63*a* of the first lower reentry roller 63.

Figure 16:
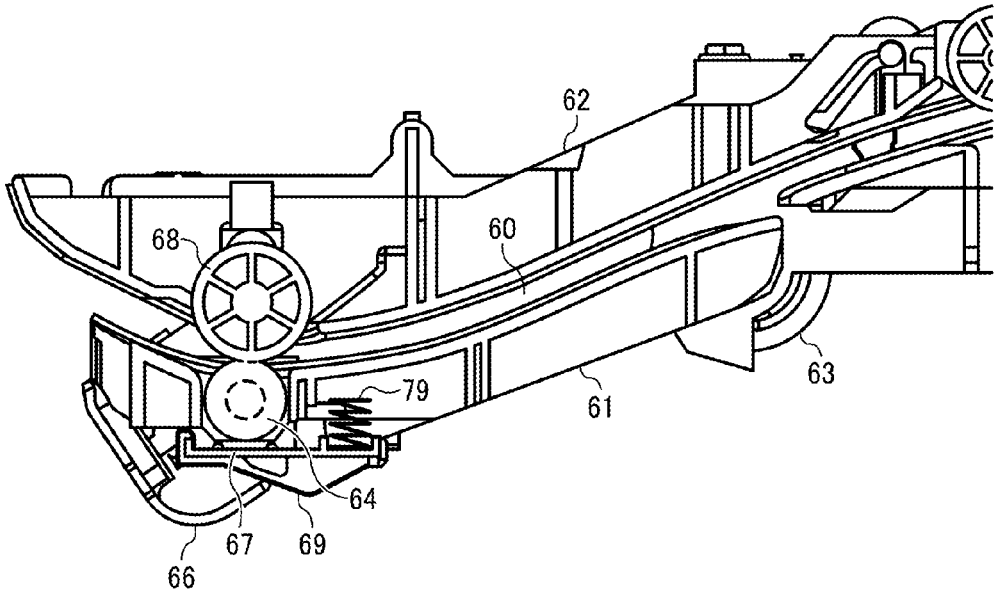
FIG. 16 is a horizontal cross sectional view illustrating the reentry path upper plate and the reentry path bottom plate.
Figure 17:
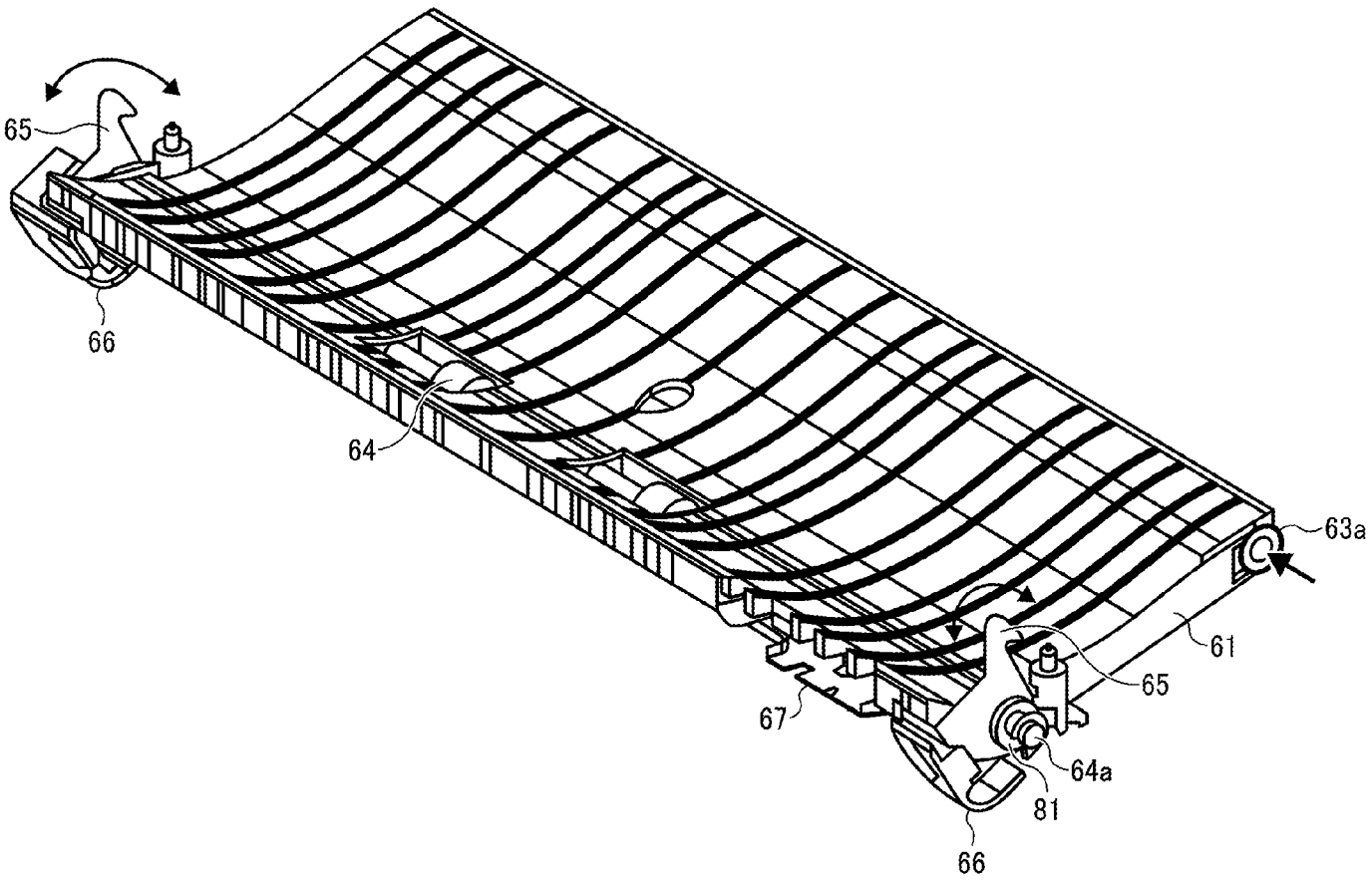
FIG. 17 is a perspective view illustrating the reentry path bottom plate of FIG. 16.

FIG. 16 is a horizontal cross sectional view illustrating the reentry path upper plate 62 and the reentry path bottom plate 61. FIG. 17 is a perspective view illustrating the reentry path bottom plate 61 of FIG. 16.

In FIGS. 16 and 17, a right end of the reentry path bottom plate 61 rotatably retains a second lower reentry roller 64. Further, as illustrated in FIG. 17, both ends in an axial direction of a rotary shaft 64*a* of the second lower reentry roller 64 swingably support respective hooks 65. Further, as illustrated in FIG. 16, a right end of the reentry path upper plate 62 rotatably supports a second upper reentry roller 68 disposed immediately above the second lower reentry roller 64. The second upper reentry roller 68 and the second lower reentry roller 64 form a second reentry nip region. The sheet S that is sandwiched by the second upper reentry roller 68 and the second lower reentry roller 64 in the second reentry nip region is conveyed in the sheet reentry path 60 from the right side to the left side in FIG. 16.

As illustrated in FIG. 15, the hook 65 that swings about the rotary shaft 64*a* of the second lower reentry roller 64 has a hooking part to hook to a hook receiver 62*a* that functions as a mounting member and is disposed projecting from a side face of the reentry path upper plate 62 at a position where a free end of the hook 65 is directed upward in a vertical direction. By hooking the hook 65 to the hook receiver 62*a*, the reentry path bottom plate 61 that is rotatable about the rotary shaft 63*a* of the first lower reentry roller 63 is locked to a first position that forms the floor of the sheet reentry path 60.

It is to be noted that the hook 65 illustrated in FIG. 15 is rotatably supported at the front end of the rotary shaft 64*a* of the second lower reentry roller 64. However, a hook that is identical to the hook 65 is also rotatably supported at the rear end of the rotary shaft 64*a* of the second lower reentry roller 64 and is hooked to a hook receiver, which is identical to the hook receiver 62*a*, projecting from the side face of the reentry path upper plate 62.

Figure 27:
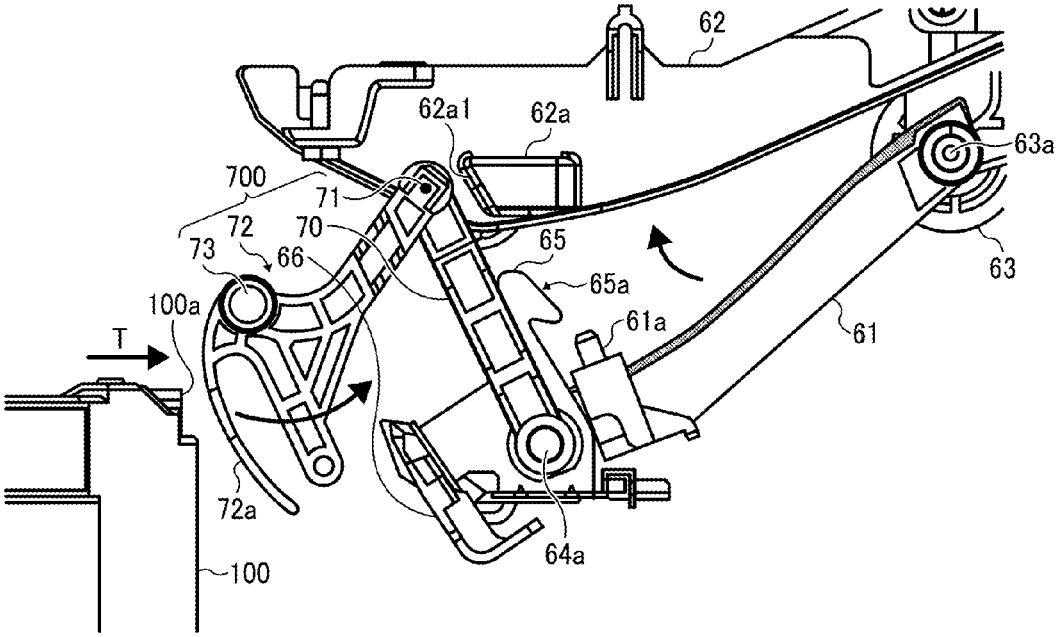
FIG. 27 is a diagram illustrating a sheet tray, a reentry path upper plate, a reentry path bottom plate, and a linked lifter included in the image forming apparatus.

Further, a releasing operation (also, an unlocking operation) described below unlocks (releases) the hook 65 from the hook receiver 62*a*, so as to eliminate a support of a left end of the reentry path bottom plate 61 in FIG. 15. Accordingly, the reentry path bottom plate 61 rotates about the rotary shaft 63*a* of the first lower reentry roller 63 to incline the left end thereof downwardly, as illustrated in FIG. 27, thereby exposing an inside of the sheet reentry path 60. In other words, the reentry path bottom plate 61 moves from the first position to a second position. Accordingly, as the reentry path bottom plate 61 moves, the rotary shaft 63*a* of the first lower reentry roller 63 and a bearing 80 that is fixedly attached to the reentry path bottom plate 61 function as a swing unit to move the reentry path bottom plate 61 between the first position and the second position.

Figure 18:
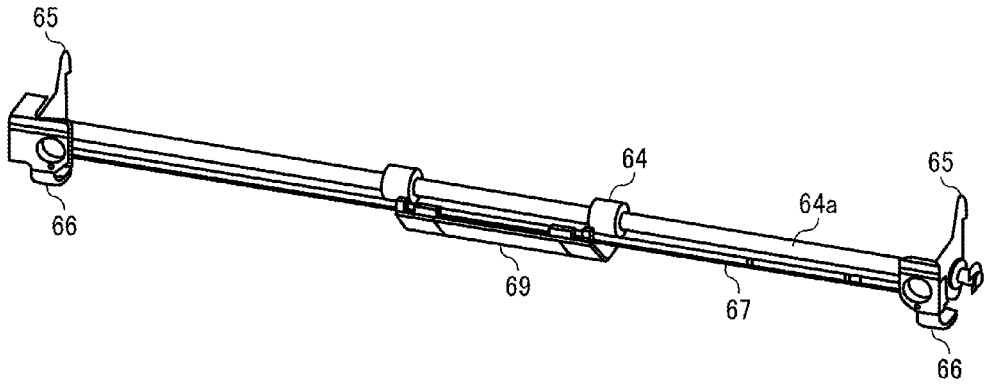
FIG. 18 is a perspective view illustrating a second lower reentry roller that is supported by the reentry path bottom plate and part of a lock releasing unit that locks and releases the reentry path bottom plate at a first position.

FIG. 18 is a perspective view illustrating the second lower reentry roller 64 that is supported by the reentry path bottom plate 61 and a part of a lock releasing unit 800 that locks and releases (unlocks) the reentry path bottom plate 61 at the first position.

As illustrated in FIG. 18, respective cushion projections 66 formed by a resin material are disposed at respective swing sides of the hooks 65 swingably supported at both ends in the axial direction of the rotary shaft 64*a* of the second lower reentry roller 64. Details of the cushion projections 66 are described later.

A beam plate 67 is disposed in the vicinity of the rotary shaft 64*a* at a position where the beam plate 67 is located parallel to the rotary shaft 64*a*. The beam plate 67 is illustrated as a bar shaped member in a perspective view of FIG. 18. However, the beam plate includes a thin sheet metal plate, as later illustrated in FIG. 27.

As illustrated in FIG. 18, one end in the axial direction of the beam plate 67 is fixed to a left end in a swing shaft direction of the hook 65 and the other end in the axial direction of the beam plate 67 is fixed to a right end in the swing shaft direction of the hook 65. Accordingly, by linking the hooks 65 disposed at both the right and left ends in the swing shaft direction thereof via the beam plate 67, the hooks 65 integrally swing in an identical phase to each other.

A release operating unit 69 is fixedly attached at a center part in a longitudinal direction of the beam plate 67. The release operating unit 69 is formed by a resin material so that an operator pushes by his/her hand. Detailed operations performed by the release operating unit 69 are described below.

As illustrated in FIG. 16, a compression spring 79 that functions as a biasing member is fixedly attached to a lower surface of the reentry path bottom plate 61. The compression spring 79 presses the right end of the beam plate 67 downwardly in the vertical direction. By so doing, a force to rotate the two hooks 65 about the rotary shaft 64*a* in a clockwise direction are applied to the hooks 65, as illustrated in FIG. 17. However, the beam plate 67 is in contact with a stopper. By so doing, the hooks 65 are prevented from rotating at a position where the free end of each of the hooks 65 is directed upward in the vertical direction.

Figure 19:
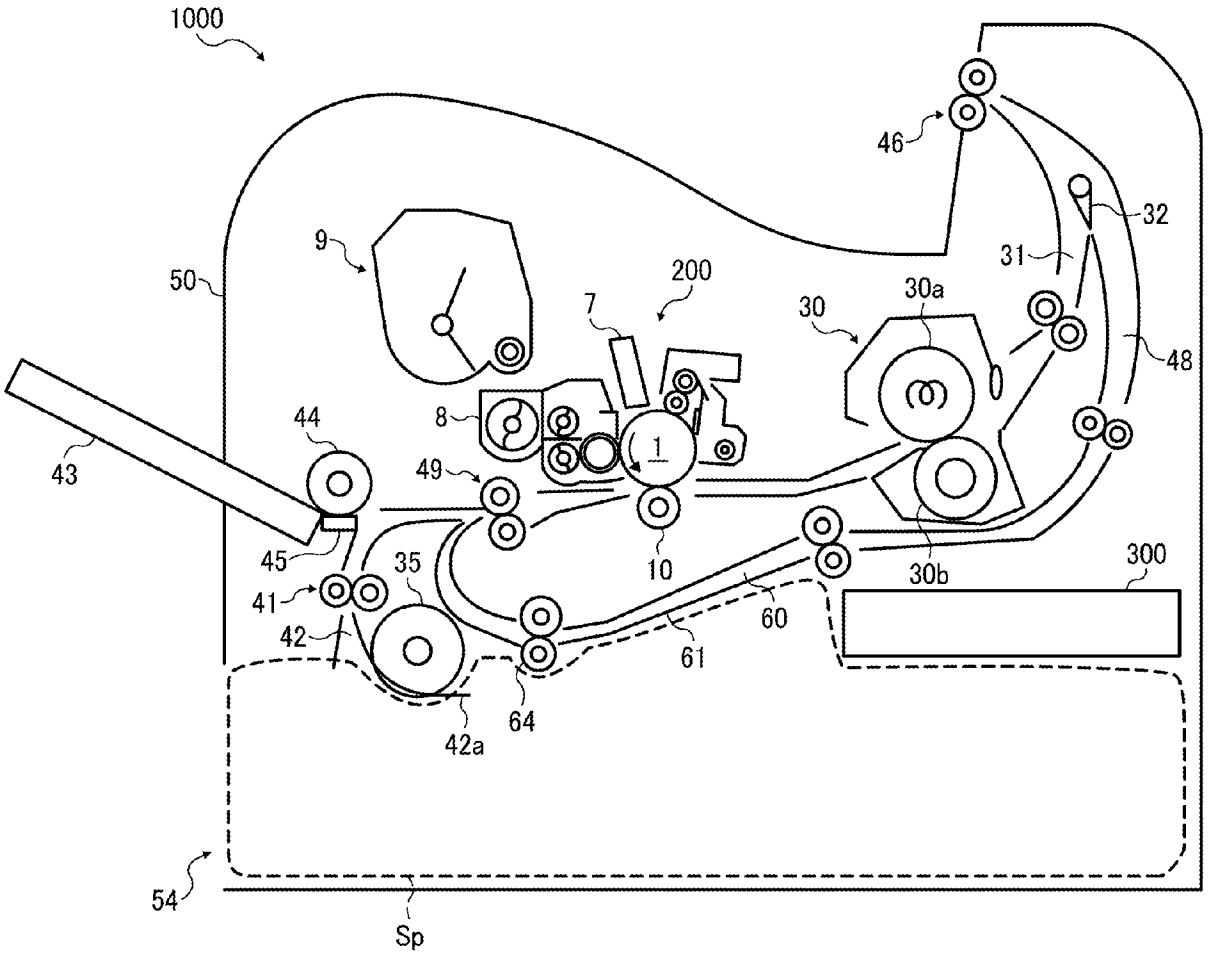
FIG. 19 is a schematic diagram illustrating the image forming apparatus with the sheet tray removed.

When a paper jam occurs in the sheet reentry path 60, while pulling the sheet tray 100 in the apparatus body 50 as illustrated in FIG. 6, an operator removes the sheet tray 100 from the apparatus body 50 as illustrated in FIG. 19. By detaching the sheet tray 100 from the apparatus body 50, the operator inserts his/her hand into an in-body space Sp to push the release operating unit 69 upward, as indicated by arrow J in FIG. 20. After the release operating unit 69 is pushed upwardly, the hook 65 is rotated about the rotary shaft 64*a* of the second lower reentry roller 64 by a given angle in a counterclockwise direction as indicated by arrow K in FIG. 19. By so doing, the hooking part of the hook 65 is released from the hook receiver 62*a*. Consequently, the left end of the reentry path bottom plate 61 is not supported as illustrated in FIG. 19. Therefore, the reentry path bottom plate 61 inclines to the second position at which the left end thereof is directed downward in the direction of gravitation, so that the inside of the sheet reentry path 60 is widely exposed, as illustrated in FIG. 21. With this exposure of the sheet reentry path 60, the jammed sheet can be removed from the sheet reentry path 60 easily.

It is to be noted that, in the image forming apparatus 1000, the hook receiver 62*a*, the rotary shaft 64*a*, a bearing 81 attached to the hook 65 to engage with the rotary shaft 64*a*, and the hooks 65 form and function as the lock releasing unit 800 to lock and release (unlock) the reentry path bottom plate 61 with respect to the first position of the sheet reentry path 60.

It is preferable that the release operating unit 69 is disposed at a position where an operator can visually recognize easily through an opening 54 (hereinafter, a sheet tray space opening 54 as illustrated in FIGS. 19 and 21) which is made in the apparatus body 50 after the sheet S is removed from the apparatus body 50. To do so, it is preferable that the release operating unit 69 is disposed at a right position of the sheet feed roller 35 as illustrated in FIG. 22.

However, if the release operating unit 69 is located to this position, the release operating unit 69 is hidden by sheet feed guide plates 42*a*. Specifically, an operator looks into the apparatus body 50 through the sheet tray space opening 54 at an angle as indicated by arrow in FIG. 22. However, when the operator looks into the apparatus body 50 from this angle, the release operating unit 69 is hidden behind an approximately lower half of the sheet feed guide plates 42*a* that defines the sheet conveying path 42.

Figure 22:
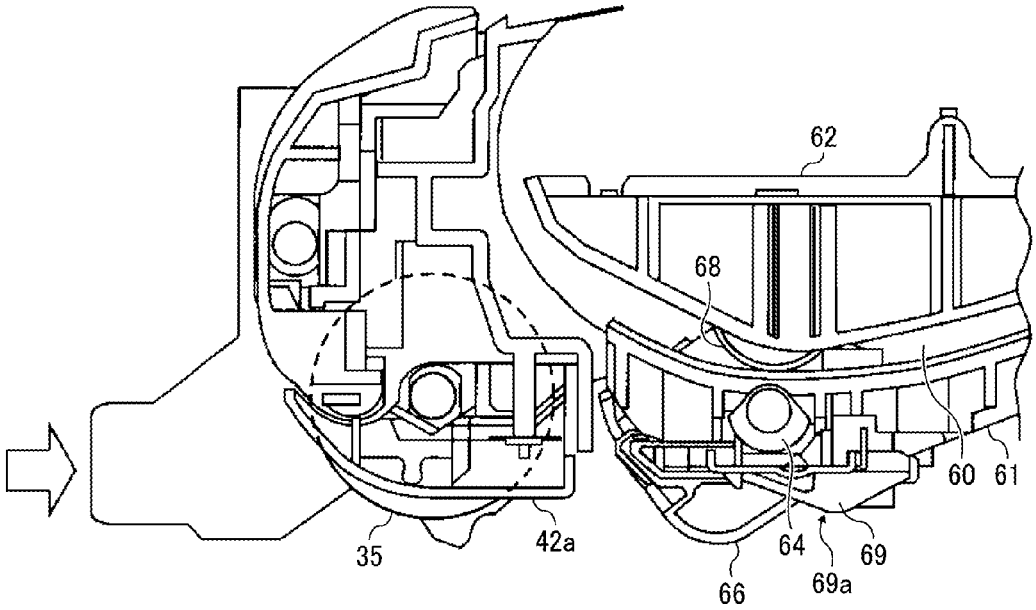
FIG. 22 is an enlarged view illustrating the sheet reentry path and units therearound in the image forming apparatus.

It is to be noted that, in order to avoid a contact to the sheet feed roller 35, the approximately lower half of the sheet feed guide plates 42*a* in FIG. 22 is disposed closer to a near side area and a far side area of the apparatus body 50 of the image forming apparatus 1000 than the sheet feed roller 35.

In the image forming apparatus 1000, in order to make the release opening unit 69 visual to the operator, the release operating unit 69 is disposed at the space between the reentry path bottom plate 61 in the vertical direction and the sheet tray 100 set in the apparatus body 50. More specifically, the release opening unit 69 is disposed immediately below the second lower reentry roller 64, as illustrated in FIG. 22. For the purpose for higher visual recognition of the release operating unit 69 through the sheet tray space opening 54 formed on the apparatus body 50, an operation face 69*a* is provided to the release operating unit 69. The operation face 69*a* can be visually recognized through the sheet tray space opening 54 of the apparatus body 50.

In the image forming apparatus 1000, the operation face 69*a* of the release operating unit 69 is disposed at the above-described position. However, the position of the operation face 69*a* is not limited thereto. For example, even if the operation face 69*a* extends in a substantially horizontal direction, the release operating unit 69 can cause the hook 65 to remove from the hook receiver 62*a* to tilt the reentry path bottom plate 61.

In this case, however, even if the operator looks into the apparatus body 50 through the sheet tray space opening 54 formed on the apparatus body 50 after the sheet tray 100 is removed, the operation face 69*a* that extends in the horizontal direction cannot be recognized visually. Due to this reason, the operator inserts his/her hand into the space to find the operation face 69*a*, which degrades the operability significantly.

Further, when the operation face 69*a* that extends in a substantially vertical direction is employed, if the operator presses the operation face 69*a* by hand, a rotation force cannot be applied to the hook 65. Accordingly, the hook 65 cannot be released from the hook receiver 62*a*. In other words, the reentry path bottom plate 61 cannot be tilted.

Further, the release operating unit 69 increases in size in the vertical direction, an increased space for installing the release operating unit 69 in the vertical direction increases the size of an image forming apparatus.

To address this inconvenience, the image forming apparatus 1000 employs the operation face 69*a* that is tilted in both the vertical direction and the horizontal direction, as illustrated in FIG. 22. According to this configuration, when the operator looks into the apparatus body 50 through the sheet tray space opening 54 of the apparatus body 50, the operation face 69*a* can be visually recognized, thereby securing good operability. At the same time, by operating the operation face 69*a*, the release operating unit 69 can cause the hook 65 to release from the hook receiver 62*a*.

It is to be noted that a preferable angle of inclination of the operation face 69*a* to the vertical direction (i.e., an inclination angle β illustrated in FIG. 24) falls in a range of from 15 degrees to 75 degrees.

Figure 20:
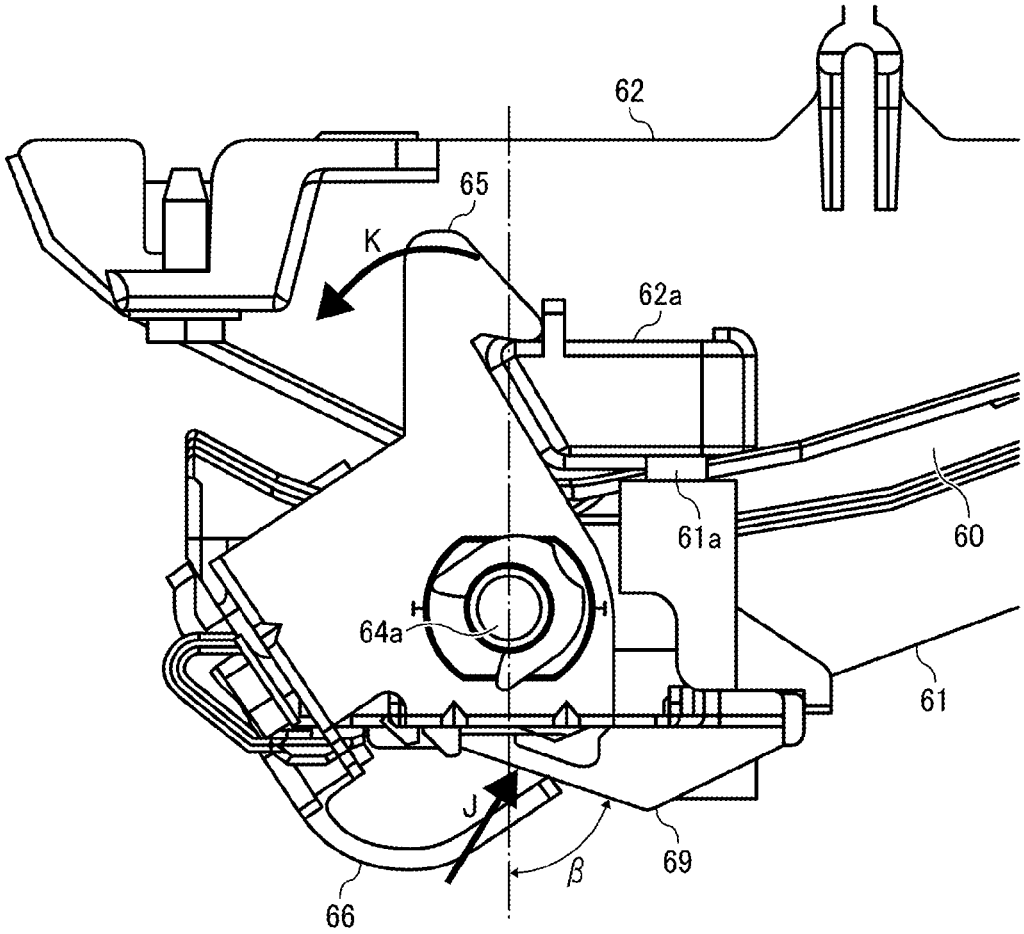
FIG. 20 is a diagram illustrating respective movements of the release operating unit and a hook when the locking of the reentry path bottom plate is released.
Figure 21:
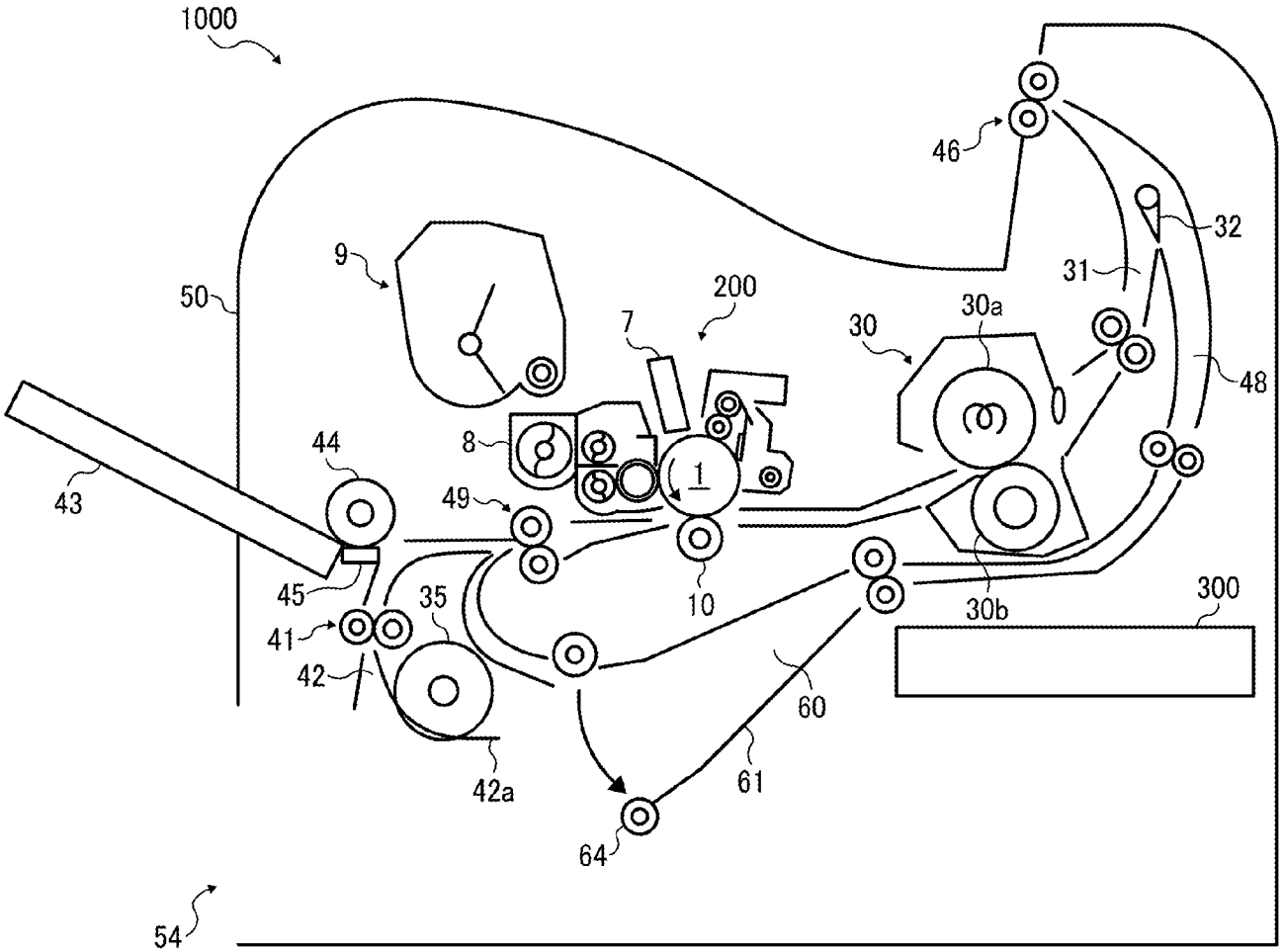
FIG. 21 is a schematic diagram illustrating the image forming apparatus with the sheet reentry path widely exposed by an inclining action of the reentry path bottom plate.

In FIG. 20, the following two operations can be performed by the release operating unit 69 to release (unlock) the hook 65 from the hook receiver 62*a* by rotating about the rotary shaft 64*a* in the counterclockwise direction.

Figure 23:
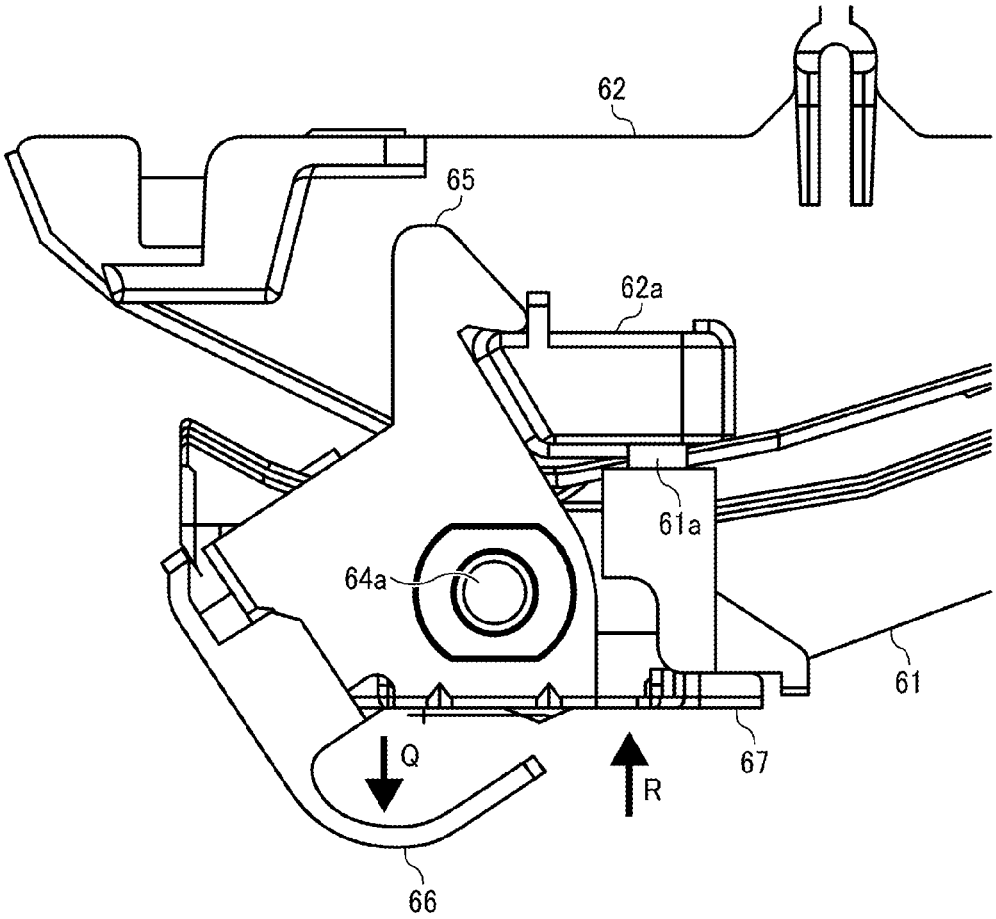
FIG. 23 is a diagram illustrating operation of the release operating unit when the reentry path bottom plate is released.

The first one of the two operations is to manually press down the left side range from the rotary shaft 64*a* in the whole range in the left-to-right direction of the beam plate 67 in FIG. 23 against the biasing force applied by the compression spring 79 (see FIG. 16), as indicated by arrow Q in FIG. 23. The second one of the two operations is to manually press up the right side range from the rotary shaft 64*a* in the whole range in the left-to-right direction of the beam plate 67 in FIG. 23 against the biasing force applied by the compression spring 79 (see FIG. 16), as indicated by arrow R in FIG. 23.

Figure 24:
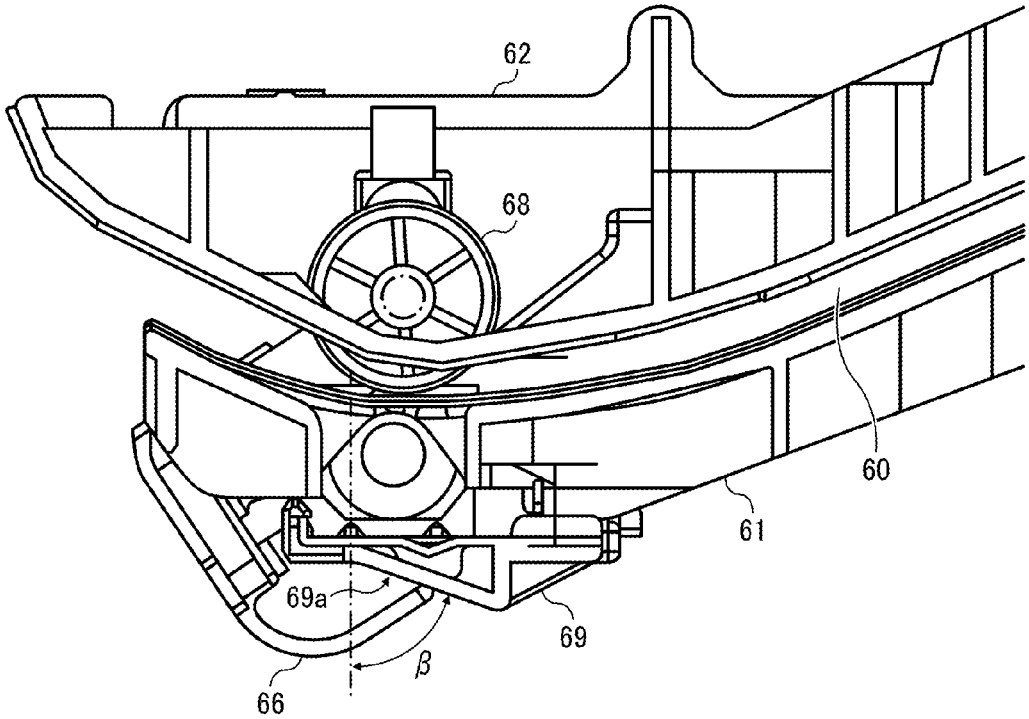
FIG. 24 is a diagram illustrating an angle of an operation face of the release operating unit.

By contrast, in order to increase visual recognition of the operation face 69*a*, the operation face 69*a* of the release operating unit 69 has a relatively large area as illustrated in FIG. 24. By describing steps or processes to expose the sheet reentry path 60 on the operation face 69*a*, an operator can easily understand the steps or processes.

Of the two operations described above, the first operation cannot be performed by operating the operation face 69*a* itself. In order to realize the first operation, a finger receiver to hook the finger of an operator is required. However, the operation face 69*a* cannot function as a finger receiver. For this reason, an upright finger receiver that projects upward from the operation face 69*a* is required. In this case, an area to describe the steps or processes of the first operation becomes smaller, and therefore the texts to write thereon also become smaller. As a result, the visual recognition of the release operating unit 69 becomes worse.

By contrast, the second operation can be performed by pushing up the operation face 69*a*, no finger receiver is attached to the operation face 69*a*. By pressing up the release operating unit 69 with the hand attached to the operation face 69*a* of the release operating unit 69, the two hooks 65 are rotated in the counterclockwise direction in FIG. 23 to release the reentry path bottom plate 61.

Accordingly, the image forming apparatus 1000 according to an example of this disclosure, the installation position and shape of the release operating unit 69 are employed for the second operation. With this configuration, the whole area of the operation face 69*a* can include the description of the steps or processes of the second operation, and therefore a large size text can be used and the visual recognition of the operation can be enhanced. Specifically, the image forming apparatus 1000 has the operation face 69*a* having four letters of "PUSH" in the substantially whole area thereon to enhance the visual recognition of the operation.

In order to push up the release operating unit 69 to rotate the hooks 65 in the counterclockwise direction in FIG. 24, at least a part of the operation face 69*a* is located to the right side of the rotary shaft 64*a* as illustrated in FIG. 23. In addition, it is preferable that the area to be located on the right side is as great as possible. As the area of the operation face 69*a* on the right side of the rotary shaft 64*a* becomes greater, the release operating unit 69 can be pushed up with a smaller force due to a large action based on the principle of leverage.

In the image forming apparatus 1000, more than a half area of the operation face 69*a* over the whole area in the left-to-right direction in FIG. 24 is located on the right side of the rotary shaft 64*a*.

The release operating unit 69 can be located at any position on the beam plate 67 in the longitudinal direction thereof (i.e., the direction perpendicular to the sheet conveying direction of the sheet S). However, from a view point of transmitting respective forces evenly to the two hooks 65, it is preferable to locate the release operating unit 69 at the center in the longitudinal direction of the beam plate 67.

Figure 25:
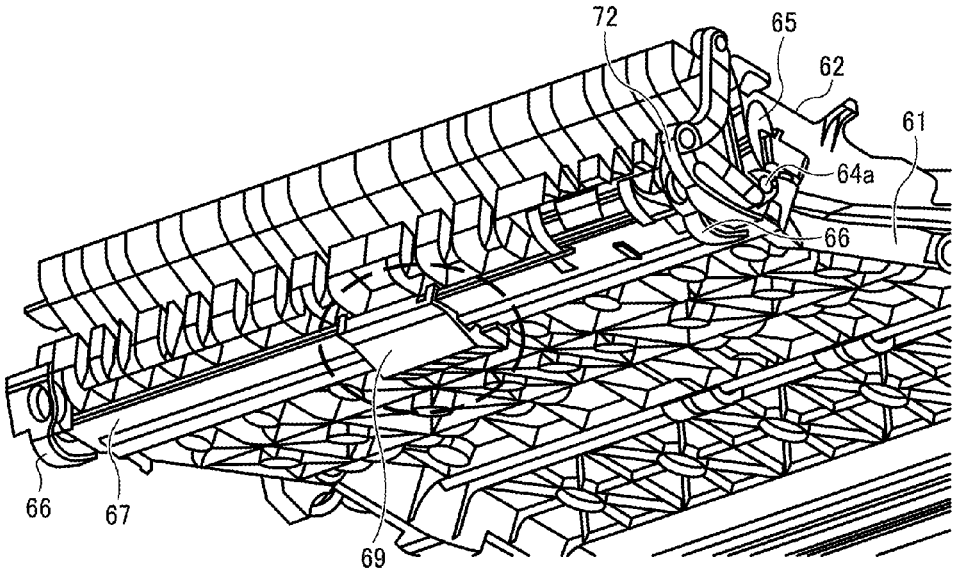
FIG. 25 is a perspective view illustrating the reentry path bottom plate and the reentry path upper plate, viewed from below.
Figure 26:
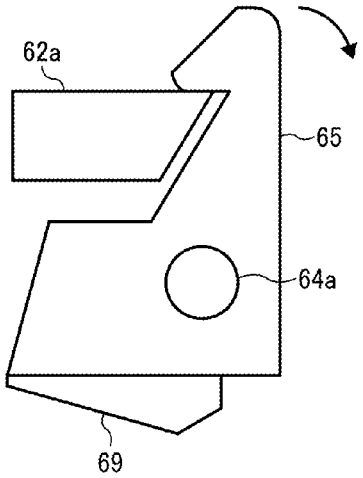
FIG. 26 is a diagram illustrating an action of a hook disposed at an opposite side to another hook illustrated in FIG. 23.

So far, the swing operation of the hook 65 disposed at the near side in FIG. 25 has been described. However, FIG. 26 illustrates the swing operation of the hook 65 disposed at the far side in FIG. 25, viewed from the far side to the near side.

In the image forming apparatus 1000 according to an example of this disclosure, after tilting the reentry path bottom plate 61 to the second position as illustrated in FIG. 27 and removing the jammed sheet remaining in the sheet reentry path 60, the operator can insert the sheet tray 100 into the apparatus body 50 without returning the reentry path bottom plate 61 to the first position manually. Therefore, a linked lifter 700 is provided to lift the reentry path bottom plate 61 from the second position to the first position in conjunction with movement of the sheet tray 100 being inserted into the apparatus body 50. The linked lifter 700 includes cushion projections 66, an arm 70, a revolution connecting part 71, a rotary contact member 72, a rotary shaft 73, and the like.

The arm 70 is a long plate having a lower vertical end slidably supported by the rotary shaft 64*a* of the second lower reentry roller 64, and therefore can revolve about the rotary shaft 64*a*. An upper vertical end of the arm 70 and an upper vertical end of the rotary contact member 72 are connected via the revolution connecting part 71. With this structure, the arm 70 can also revolve about the revolution connecting part 71.

However, the rotary contact member 72 is rotatably supported on a circumferential surface of the rotary shaft 73 having a center part in a longitudinal direction thereof cannot rotate. Consequently, the rotary shaft 73 hinders the rotary contact member 72 from revolving about the revolution connecting part 71 while the rotary shaft 73 allows the rotary contact member 72 to rotate about the rotary shaft 73.

An angle of rotation of the rotary contact member 72 about the rotary shaft 73 changes according to an angle of revolution of the arm 70 about the revolution connecting part 71 and an angle of inclination of the reentry path bottom plate 61. Specifically, as the rotary contact member 72 rotates about the rotary shaft 73 in the counterclockwise direction in FIG. 27, a left end of the reentry path bottom plate 61 in FIG. 27 is lifted via the arm 70. Along with this action, the arm 70 revolves about the revolution connecting part 71 in the clockwise direction in FIG. 27 to move to a position facing directly downward in the vertical direction.

As indicated by arrow T illustrated in FIG. 27, as the sheet tray 100 is inserted into the apparatus body 50, an upper edge 100*a* of a leading end of the sheet tray 100 eventually contacts a cushion contact part 72*a* of the rotary contact member 72. In this state, as the sheet tray 100 further moves into the apparatus body 50, the upper edge 100*a* of the sheet tray 100 applies a rotation force to the rotary contact member 72 in the counterclockwise direction of FIG. 27. Accordingly, the rotary contact member 72 rotates in the counterclockwise direction in FIG. 27, resulting in lifting a left end of the reentry path bottom plate 61 in FIG. 27.

As the sheet tray 100 further moves into the apparatus body 50, the rotary contact member 72 further rotates in the counterclockwise direction in FIG. 27. With this action, the left end of the reentry path bottom plate 61 is further lifted until an upper end of the hook 65 contacts the hook receiver 62*a* of the reentry path upper plate 62.

A taper 65*a* is formed at the upper end of the hook 65. Further, an inverted taper 62*a*1 is formed at a contact position of the hook receiver 62*a* contacting the hook 65. Since the hook 65 moves upwardly with the taper 65*a* thereof sliding on the inverted taper 62*a*1 of the hook receiver 62*a*, the hook 65 can move upwardly from a position lower than the hook receiver 62*a* without being caught by the hook receiver 62*a*.

Figure 28:
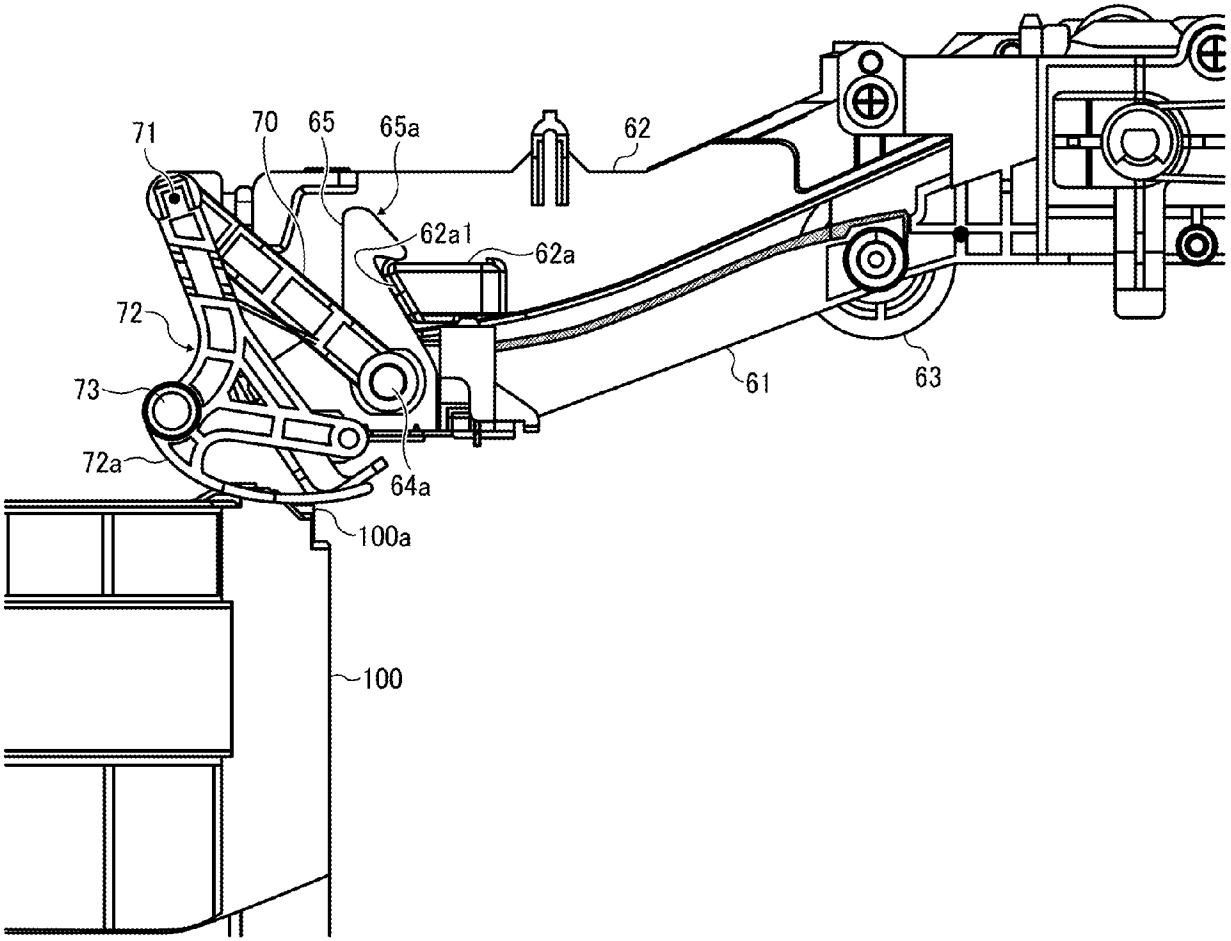
FIG. 28 is a diagram illustrating respective postures and positions of a rotary contact member that is completely run aground an upper edge of the sheet tray and units around the rotary contact member.

As the sheet tray 100 further moves into the apparatus body 50, the cushion contact part 72*a* of the rotary contact member 72 completely runs aground a side plate of the sheet tray 100, as illustrated in FIG. 28. Immediately after the cushion contact part 72*a* has run aground the sheet tray 100, the hook 65 has not reached a position where the hook 65 is completely hooked to the hook receiver 62*a*. If the sheet tray 100 further moves into the apparatus body 50 in this state, the cushion projections 66 that is fixedly attached to the hook 65 runs on the upper edge 100*a* of the sheet tray 100 so as to cause the hook 65 to further move upward. According to this action, the hooking part of the hook 65 is completely hooked to the hook receiver 62*a* and, as a result, the reentry path bottom plate 61 is locked to the first position.

Figure 29:
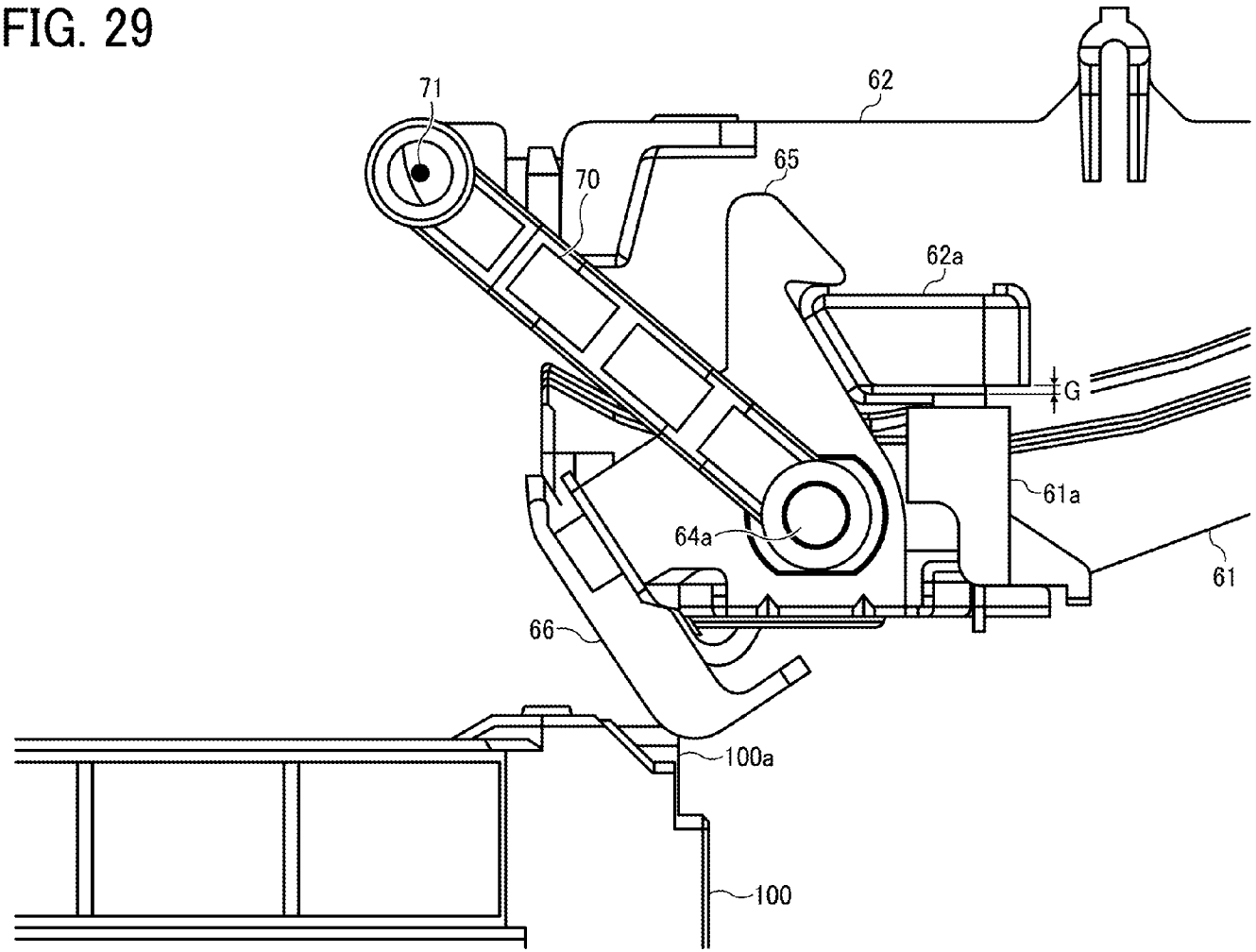
FIG. 29 is a perspective view illustrating the sheet tray of FIG. 28 viewed from above.

As described above, in the state in which the reentry path bottom plate 61 is locked to the first position, a gap G of 2 mm to 3 mm is formed between a lower surface of the hook receiver 62*a* of the reentry path upper plate 62 and an upper end surface of a stopper 61*a* of the reentry path bottom plate 61. While running aground the upper edge 100*a* of the sheet tray 100, the cushion projections 66 lifts the left end of the reentry path bottom plate 61 in FIG. 29 until the left end of the reentry path bottom plate 61 reaches a position where the amount of the gap G becomes substantially zero. By so doing, the hooking part of the hook 65 can be hooked to the hook receiver 62*a* reliably.

Thereafter, as the sheet tray 100 further moves into the apparatus body 50, the cushion projections 66 are moved off from the upper edge 100*a* of the sheet tray 100, and therefore moves onto the side plate of the sheet tray 100 that is located lower than the cushion projections 66. Accordingly, the volume of the gap G increases in a range of from 1 mm to 3 mm.

Figure 30:
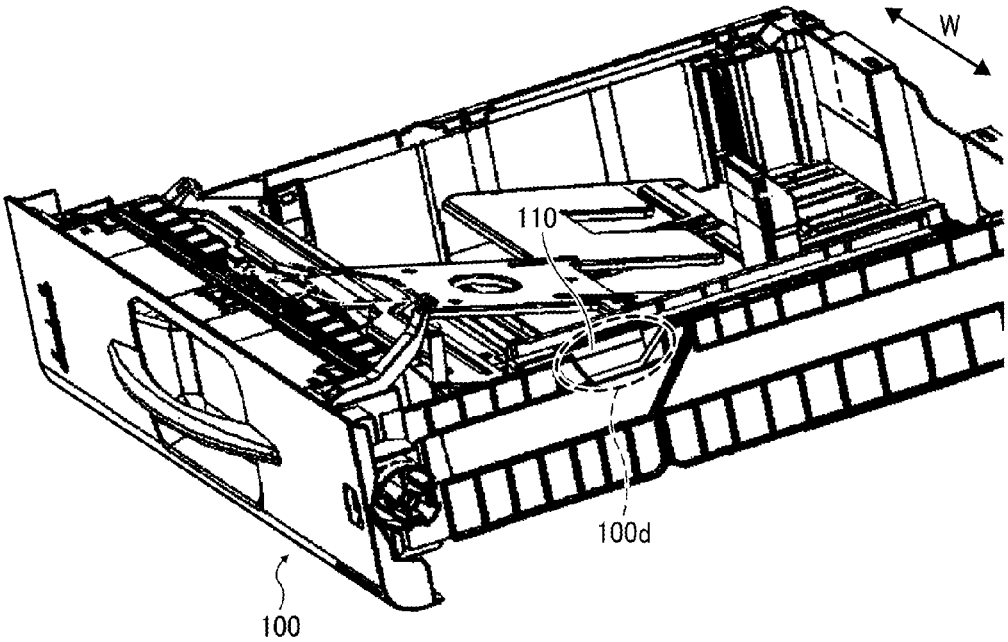
FIG. 30 is a perspective view illustrating the sheet tray when a curl correcting body is detached therefrom and attached thereto.

The side plate of the sheet tray 100 includes two plates, which are an outside plate and an inside plate, as illustrated in FIG. 30. The outside plate is located to the front end side of the sheet tray 100 at the right side in FIG. 30. The inside plate is located to the rear end side closer to the center of the sheet tray 100 from the outside plate. The cushion contact part 72*a* of the rotary contact member 72 illustrated in FIG. 28 is disposed aground on the outside plate of the sheet tray 100, and therefore does not contact the inside plate disposed closer to the center of the sheet tray 100 than the outside plate.

As illustrated in FIG. 28, a notched recess 100*d* is formed on the upper end of the inside plate of the sheet tray 100. The notched recess 100*d* is provided for an operator to easily pinch a side fence 110 or side fences 110 provided in the sheet tray 100 in a sheet width direction indicated by arrow W illustrated in FIG. 30 when sliding the side fence(s) 110.

When the sheet tray 100 is fully inserted in the apparatus body 50, the rotary contact member 72 illustrated in FIG. 28 is located outside the inside plate of the sheet tray 100 illustrated in FIG. 30. Therefore, the rotary contact member 72 does not contact the inside plate basically. However, when pulling the sheet tray 100 out from the apparatus body 50, the rotary contact member 72 can deform temporarily due to unexpected factor such as shock, which can cause the rotary contact member 72 to contact and get caught by the notched recess 100*d* of the inside plate of the sheet tray 100. Accordingly, the sheet tray 100 cannot be removed.

Figure 31:
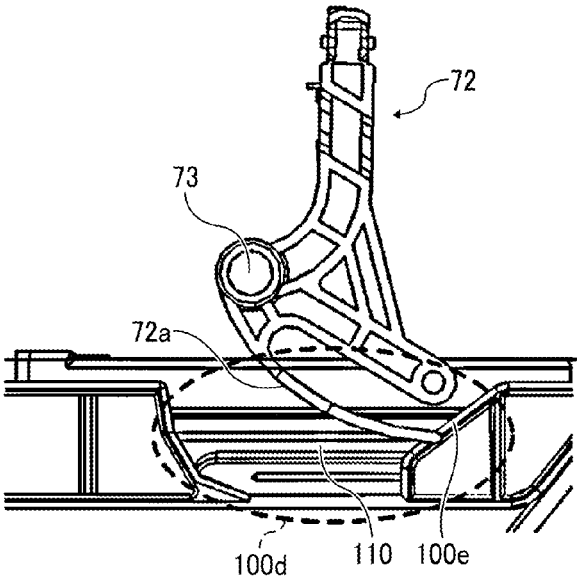
FIG. 31 is a side view illustrating an inner side plate of the sheet tray and the rotary contact member.

To address this inconvenience, the image forming apparatus 1000 further includes a taper 100*e* on an upstream wall of the notched recess 100*d* in the tray removing direction, as illustrated in FIG. 31. Since the cushion contact part 72*a* of the rotary contact member 72 slides on the taper 100*e* of the sheet tray 100, the rotary contact member 72 can be prevented from being caught to the notched recess 100*d*. According to this configuration, the sheet tray 100 can be pulled out from the apparatus body 50 without causing the rotary contact member 72 to be caught by the notched recess 100*d*.

Figure 32:
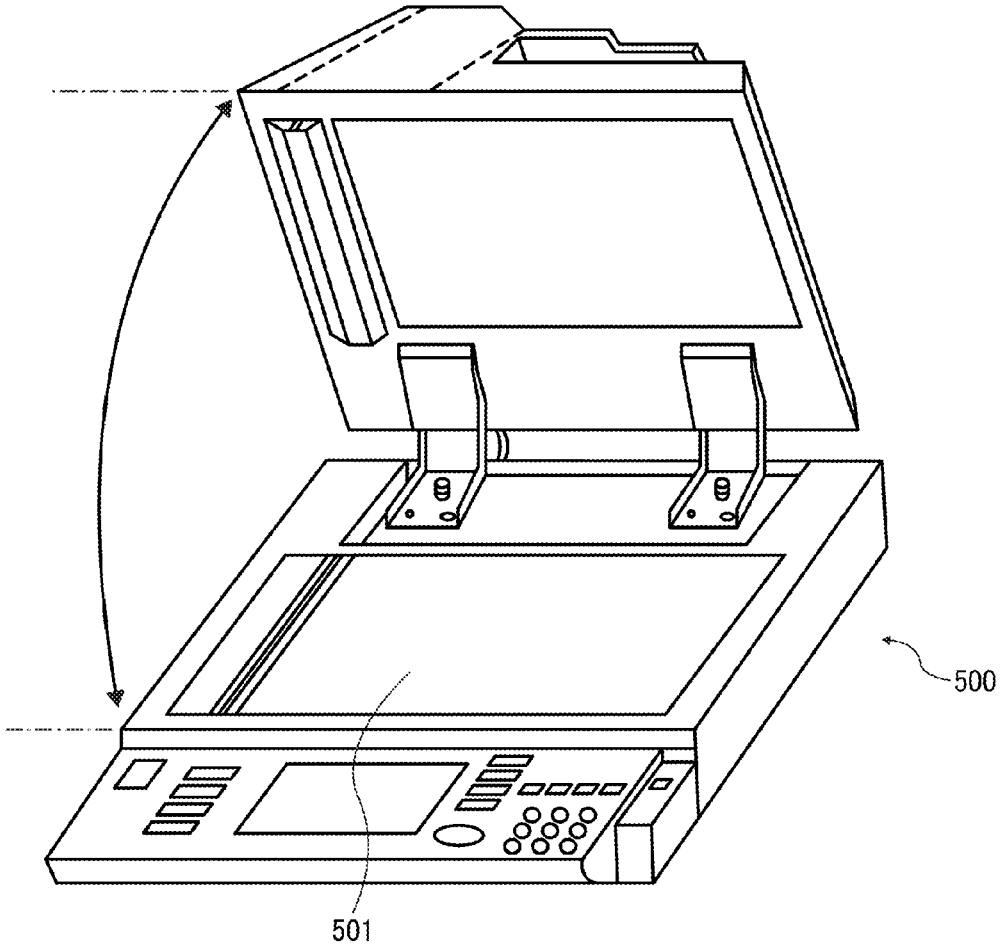
FIG. 32 is a perspective view illustrating a scanner used in an image forming system including the image forming apparatus.

FIG. 32 is a perspective view illustrating a scanner 500 used in an image forming system including the image forming apparatus 1000.

As illustrated in FIG. 32, the scanner 500 includes an exposure glass 501. With known optical techniques, the scanner 500 reads image data of an original document placed on the exposure glass 501 and transmits the scanned data to the image forming apparatus 1000.

Next, a description is given of different configurations of the image forming apparatus 1000 according to another example of this disclosure.

It is to be noted that, unless otherwise noted, the configurations in the following example or examples of the image forming apparatus are identical to the configurations of the image forming apparatus 1000 according to the above-described examples of this disclosure.

As illustrated in FIG. 12, the sheet feed roller 35 to feed the sheet S from the sheet tray 100 is disposed in a given part of the sheet tray 100 in a direction perpendicular to the sheet feeding direction as indicated by arrow B in FIG. 12. The sheet S contained in the sheet tray 100 is pressed by the sheet feed roller 35 at the center of the sheet S in the direction perpendicular to the sheet feeding direction (hereinafter, referred to as a perpendicular feed direction). In other words, a part other than the center of the sheet S is not pressed by the sheet feed roller 35 in the perpendicular feed direction B.

In this configuration, the image forming apparatus 1000 of a relatively large size capable of portrait conveyance of an A3 size paper at maximum (a sheet having the maximum size of 297 mm in the perpendicular feed direction) includes the sheet feed guide plates 42*a* as illustrated in FIG. 22. Without the sheet feed guide plates 42*a*, a paper jam can occur easily in the image forming apparatus 1000. The paper jam occurs when the sheet S cannot curve preferably along the circumferential surface of the sheet feed roller 35 and cannot convey the sheet S to a nip region formed between the sheet tray 100 and the first conveying roller pair 41. Accordingly, a paper jam occurs because the sheet S cannot get in the nip region formed between the first conveying roller pair 41.

However, it has been found that a part of the whole sheet feed guide plate 42*a* can be omitted. Specifically, the image forming apparatus 1000 of a relatively small size capable of portrait conveyance of an A4 size paper at maximum (a sheet having the maximum size of 210 mm in the perpendicular feed direction) can be omitted. Specifically, even if the approximately lower half part of the sheet feed guide plate 42*a* is omitted, the paper jam hardly occurs.

When the relatively small sheet S such as portrait conveyance of the A4 sizes paper in a portrait direction is conveyed, a rigidity of the sheet S to a certain extent in the perpendicular conveying direction.

Therefore, even if the sheet feed roller 35 contacts the center of the sheet S in the perpendicular feeding direction, the whole area in the perpendicular feeding direction of the sheet S is bent along the circumferential surface of the sheet feed roller 35, so as to feed the sheet S to the nip region.

Accordingly, the image forming apparatus 1000 according to this example of this disclosure uses a relatively small paper such as an A4 size paper in portrait direction as the maxim sheet size.

Figure 33:
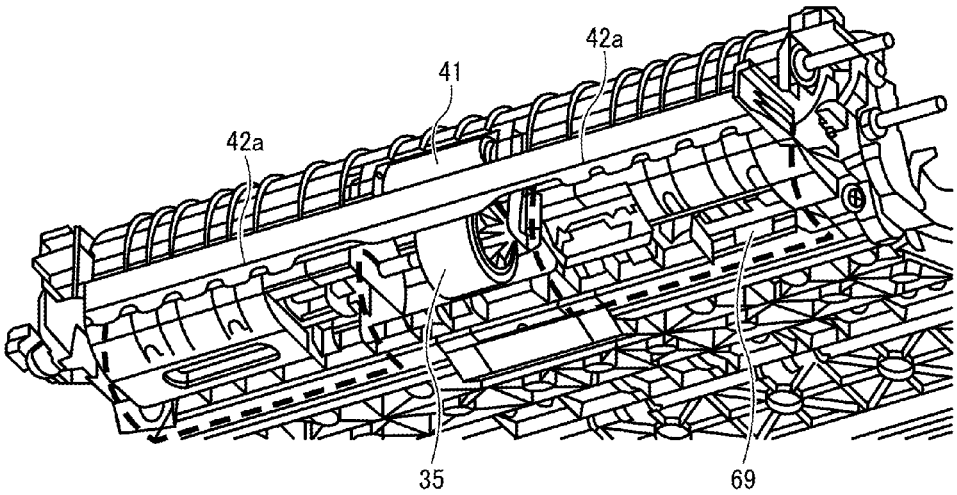
FIG. 33 is an enlarged perspective view illustrating a sheet feeding guide panel and a sheet reentry path of an image forming apparatus according to another example of this disclosure.

As illustrated in FIG. 33, the approximately lower half is omitted from the sheet feed guide plate 42*a* according to this example and the release operation unit 69 is provided to the rear side of the sheet feed roller 35 (a right side of the sheet feed roller 35 in FIG. 19).

It is to be noted that the approximately lower half of the sheet feed guide plate 42*a* according to this example of this disclosure is drawn with dotted lines in FIG. 33. By removing the lower half of the sheet feed guide plate 42*a*, an operator can visually recognize the release operating unit 69 easily through the sheet tray space opening 54.

Figure 34:
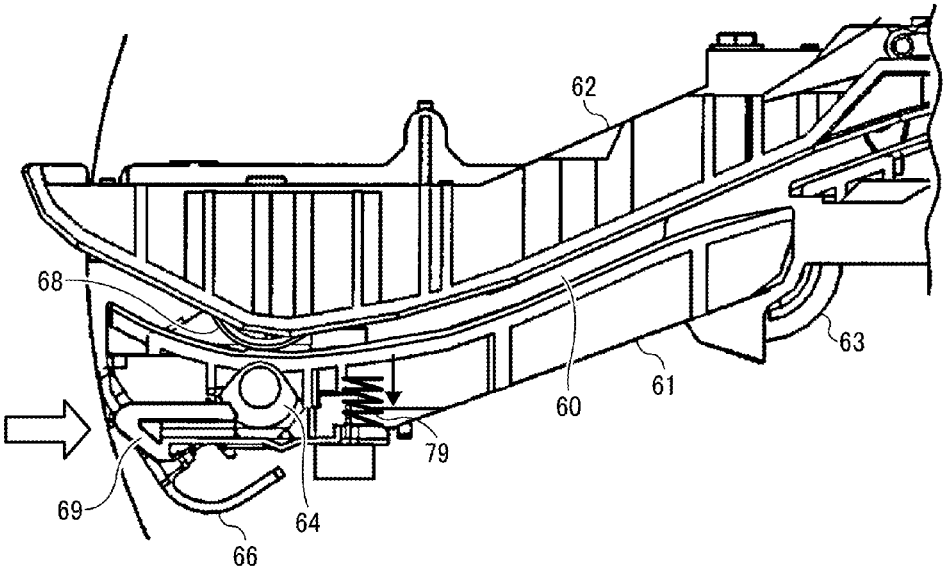
FIG. 34 is a horizontal cross sectional view illustrating the reentry path upper plate and the reentry path bottom plate of the image forming apparatus of FIG. 33.

FIG. 34 is a horizontal cross sectional view illustrating the reentry path upper plate 62 and the reentry path bottom plate 61 of the image forming apparatus 1000 of FIG. 33. The release operating unit 69 can be visually recognized easily by an operator from an angle indicated by arrow in FIG. 34 via the sheet tray space opening 54.

Figure 35:
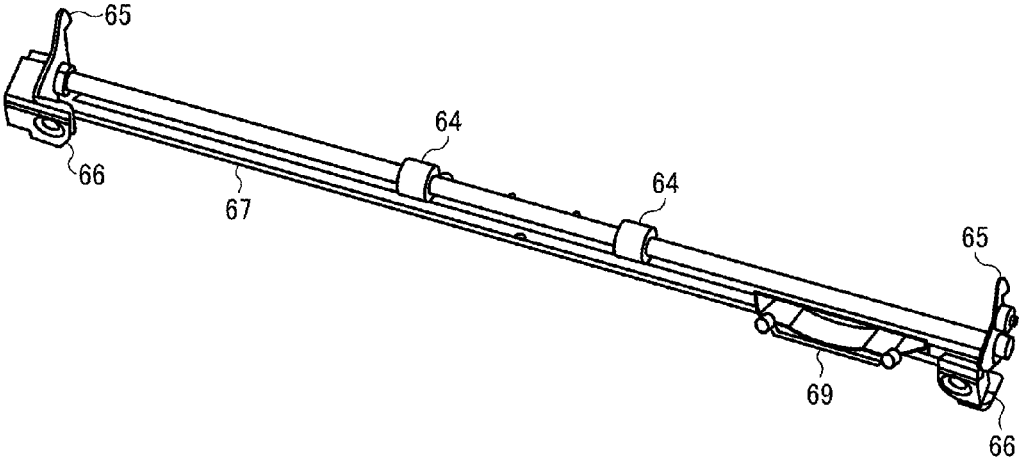
FIG. 35 is a perspective view illustrating a second lower reentry roller that is supported by the reentry path bottom plate and a partial configuration of the lock releasing unit that locks and releases the reentry path bottom plate at a first position thereof.

FIG. 35 is a perspective view illustrating the second lower reentry roller 64 that is supported by the reentry path bottom plate 61 and a partial configuration of the lock releasing unit 800 that locks and releases the reentry path bottom plate 61 at a first position thereof.

Figure 36:
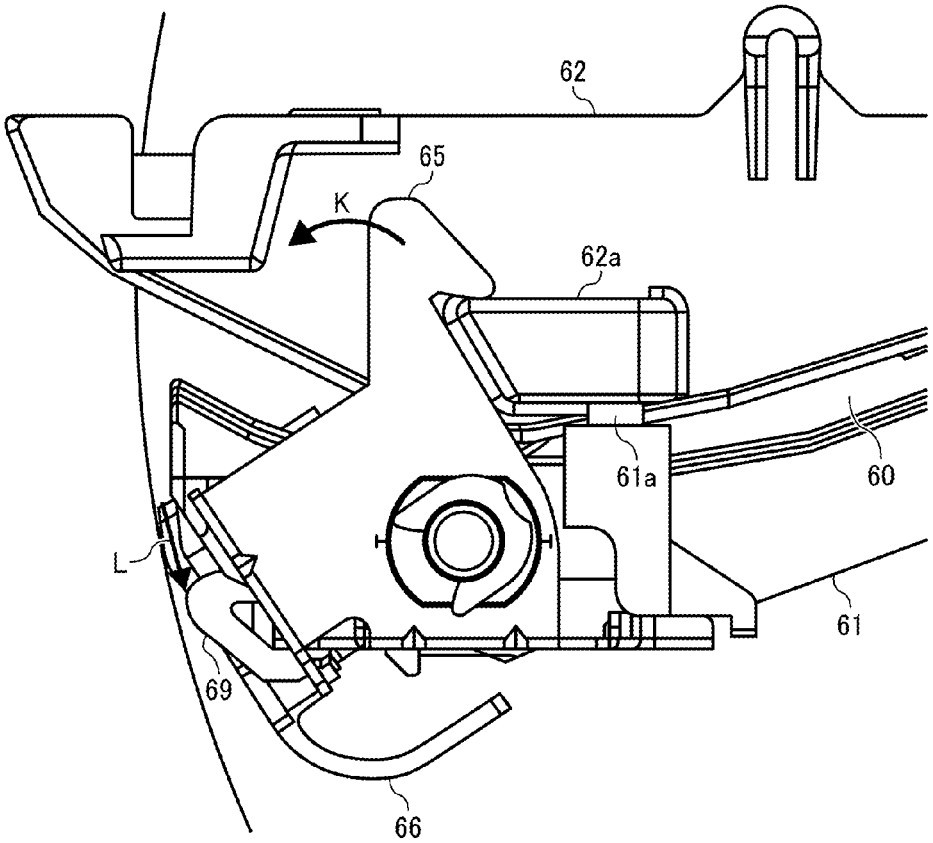
FIG. 36 is a diagram illustrating of operations of the release operating unit when unlocking the reentry path bottom plate.

As illustrated in FIG. 35, the release operating unit 69 is supported by the beam plate 67 in a cantilever manner. A free end of the release operating unit 69 is located close to the sheet tray space opening 54 than to the beam plate 67. An operator places his/her hand to the free end of the release operating unit 69 that can be visually recognized easily through the sheet tray space opening 54. Then, as illustrated in FIG. 36, the operator pushes down the release operating unit 69 with the hand in a direction indicated by arrow L in FIG. 36.

According to this configuration, compared with a configuration in which the reentry path bottom plate 61 having a certain weight is lifted, the reentry path bottom plate 61 included in the image forming apparatus 1000 can be moved to the second position with a smaller force to expose the sheet reentry path 60.

Figure 37:
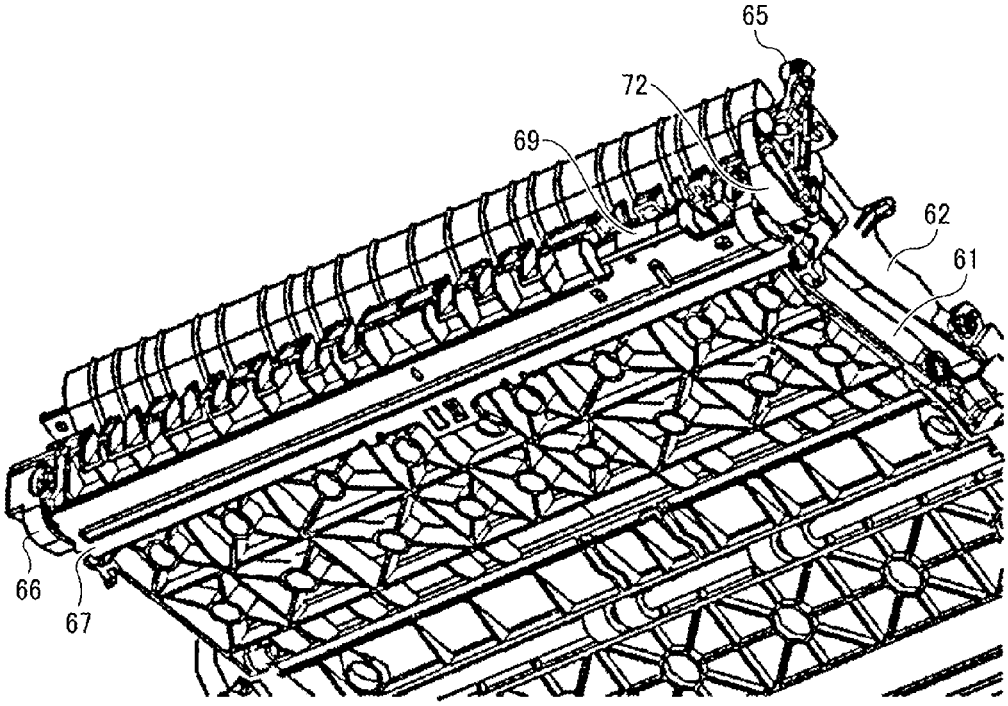
FIG. 37 is a perspective view illustrating the reentry path bottom plate and a reentry path upper plate, viewed from below.

Since most operators are considered to be right-handed, the release opening unit 69 of the image forming apparatus 1000 is fixedly attached to an end facing the right hand of an operator facing the sheet tray space opening 54 of both ends in the longitudinal direction of the beam plate 67, as illustrated in FIG. 37. According to this configuration, the operability performed by a right-handed operator can be further enhanced.

It is to be noted that the release operating unit 69 can be disposed at an end of the beam plate 67 facing the left hand of the operator due to some reasons, for example, due to the restriction of layout at an end of the beam plate 67 opposite to the above-described end facing the right hand of the operator facing the sheet tray space opening 54.

The above-described configurations are examples. This disclosure can achieve the following aspects effectively.

Aspect A.

In Aspect A, an image forming apparatus (for example, the image forming apparatus 1000) has a configuration that includes an image forming part (for example, the image forming part 200), an apparatus body (for example, the apparatus body 50), a sheet container (for example, the sheet tray 100), a sheet reentry path (for example, the sheet reentry path 60), a swing unit (for example, the rotary shaft 63*a*), a lock releasing unit (for example, the hook receiver 62*a*, the rotary shaft 64*a*, the hook 65 and the like), and a release operating unit (for example, the release operating unit 69). The image forming part forms an image on a recording medium (for example, the sheet S) having a first surface (for example, the front surface) and a second surface (for example, the rear surface). The apparatus body contains the image forming part therein. The sheet container is detachably attachable to the apparatus body and accommodates the recording medium to be supplied to the image forming part. The sheet reentry path is disposed above the sheet container in the apparatus body and through which the recording medium having the image formed on the first surface thereof by the image forming part is conveyed again to the sheet conveying path to receive an image on the second surface of the recording medium. The sheet reentry path has a floor including at least a bottom plate (for example, the bottom plate 61). The swing unit swingably moves the bottom plate between a first position to form the floor of the sheet reentry path and a second position to expose an inside of the sheet reentry path toward a space generated in the apparatus body by detachment of the sheet container as the bottom plate of the floor of the sheet reentry path swings. The lock releasing unit 800 is provided in the apparatus body and to lock and release the bottom plate of the sheet reentry path with respect to the first position of the swing unit. The release operating unit causes the lock releasing unit 800 to release the bottom plate from the first position of the swing unit.

According to this configuration of Aspect A, an operator moves the reentry path bottom plate from the first position to the second position to expose the inside of the sheet reentry path to the space inside the apparatus body with the sheet container disposed below the sheet reentry path removed from the apparatus body. This exposure of the inside of the sheet reentry path makes it easy to remove a jammed sheet from the sheet reentry path.

Further, in the configuration of Aspect A, the operator inserts his/her hand in the space of the apparatus body that has become accessible due to detachment of the sheet container and operates the release operating unit that is supported by the reentry path bottom plate, thereby releasing the reentry path bottom plate that is locked to the first position. In this configuration, the release operating unit disposed in the apparatus body is operated to release the reentry path bottom plate. Therefore, different from the above-described comparative image forming apparatus, the image forming apparatus according to the above-described examples of this disclosure can release the reentry path bottom plate without a long lever that extends over an area from the outside of the apparatus body to the reentry path bottom plate in the apparatus body. As a result, the image forming apparatus according to the above-described examples of this disclosure does not include any long lever.

Accordingly, the image forming apparatus can provide a simple configuration of the lock releasing unit, and therefore can prevent deterioration of maintainability thereof.

Aspect B.

In Aspect A, the apparatus body has an opening (for example, the sheet tray space opening 54) formed when the sheet container is detached therefrom and the release operating unit is disposed in an area visible through the opening within a whole space inside the apparatus body.

According to this configuration of Aspect B, the release operating unit can be operated reliably by an operator intervention with his/her hand inserted into the apparatus body.

Aspect C.

In Aspect A or B, the apparatus body includes a mounting member (for example, the hook receiver 62*a*) that is fixedly attached thereto. The lock releasing unit includes a hook (for example, the hook 65) to hook to the mounting member and to swingably lock the bottom plate of the sheet reentry path and a biasing member (for example, the compression sprint 79) to apply a biasing force to bias the hook toward a given swing stop position. The release opening unit is an operating unit to apply a force to the hook to separate from the given swing stop position against the biasing force exerted by the biasing member.

According to this configuration of Aspect C, the hook is slightly rotated in a swing direction. This simple operation can unlock and release the reentry path bottom plate.

Aspect D.

In Aspect C, the release operating unit is disposed at a position where the hook moves in a direction to separate from the given swing stop position as the release operating unit is pressed upward.

According to this configuration of Aspect D, a greater number of unintended operation errors of the release operating unit can be prevented in comparison to the configuration of Aspect F as described below.

Aspect E.

In any of Aspect D, the release operating unit has an operation surface (for example, the operation face 69*a*) to be touched for operation. The operation surface is tilted from both a vertical direction and a horizontal direction.

According to this configuration of Aspect E, when an operator looks into the apparatus body through the sheet tray space opening of the apparatus body, the operation face can be visually recognized, thereby securing good operability and the operation face can be operated reliably.

Aspect F.

In Aspect C, the release operating unit is disposed at a position where the hook moves in a direction to separate from the given swing stop position as the release operating unit is pressed downwardly.

According to this configuration of Aspect F, the operability of the release operating unit can be more enhanced in comparison to Aspects D and E.

Aspect G.

In any of Aspects C through F, the bottom plate of the sheet reentry path supports the lock releasing unit and the release operating unit.

According to this configuration of Aspect G, even if the release operating unit is located at an approximately center of the apparatus body in the perpendicular feed direction of the apparatus body, when the reentry path bottom plate is released to incline from the first position to the second position, the reentry path bottom plate is not caught by the release operating unit. It is because the operating unit moves along with movement of the reentry path bottom plate integrally. Therefore, locating the release operating unit at the center of the apparatus body can enhance the usability and visibility of the release operating unit.

Aspect H.

In Aspect G, the hook is hooked at an upper end of the mounting member. According to this configuration of Aspect H, the weight of the bottom plate of the sheet reentry path lifts the hook to the upper end of the mounting member, and therefore the bottom plate of the sheet reentry path can be locked to the first position reliably.

Aspect I.

In Aspect G or Aspect H, the image forming apparatus further includes a linked lifter (for example, the linked lifter 700 including the cushion projections 66, the arm 70, the revolution connecting part 71, the rotary contact member 72, the rotary shaft 73 and the like). The link lifter moves the bottom plate of the sheet reentry path upwardly from the second position to the first position in conjunction with movement of the sheet container as the sheet container is pressed into the apparatus body in a state in which the bottom plate of the sheet reentry path is located at the second position and the inside of the sheet reentry path is exposed.

According to this configuration of Aspect I, the work of an operator after handling the paper jam that occurred in the sheet reentry path can be simplified, and therefore the maintainability of the image forming apparatus can be enhanced.

Aspect J.

In Aspect J, a copier includes the image forming apparatus according to any one of Aspects A through E to form an image and an image reading device to read image data of an original document.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. An image forming apparatus comprising:

an image forming part to form an image on a recording medium having a first surface and a second surface;

an apparatus body to contain the image forming part therein;

a sheet container detachably attachable to the apparatus body and to accommodate the recording medium to be supplied to the image forming part;

a sheet conveying path through which the recording medium is conveyed from the sheet container toward the image forming part;

a sheet reentry path disposed above the sheet container in the apparatus body and through which the recording medium having the image formed on the first surface thereof by the image forming part is conveyed again to the sheet conveying path to receive an image on the second surface of the recording medium, the sheet reentry path having a floor including at least a bottom plate;

a swing unit configured to swingably move the bottom plate between a first position to form the floor of the sheet reentry path and a second position to expose an inside of the sheet reentry path toward a space generated in the apparatus body by detachment of the sheet container as the bottom plate of the floor of the sheet reentry path swings;

a lock releasing unit in the apparatus body and configured to lock and release the bottom plate of the sheet reentry path with respect to the first position of the swing unit; and a release operating unit configured to cause the lock releasing unit to release the bottom plate from the first position of the swing unit; and a linked lifter configured to lift the bottom plate of the sheet reentry oath from the second position to the first position in conjunction with movement of the sheet container as the sheet container is pressed into the apparatus body in a state in which the bottom plate is located at the second position and the inside of the sheet reentry path is exposed to the space.

2. The image forming apparatus according to claim 1, wherein the apparatus body has an opening formed when the sheet container is detached therefrom, wherein the release operating unit is in an area visible through the opening within a whole space inside the apparatus body.

3. The image forming apparatus according to claim 2, wherein the apparatus body includes a mounting member that is fixed therein, wherein the lock releasing unit includes a hook to hook to the mounting member and to swingably lock the bottom plate of the sheet reentry path; and a biasing member configured to apply a biasing force to bias the hook toward a given swing stop position, wherein the release operating unit is an operating unit to apply a force to the hook to separate from the given swing stop position against the biasing force exerted by the biasing member.

4. The image forming apparatus according to claim 1, wherein the apparatus body includes a mounting member that is fixedly attached thereto, wherein the lock releasing unit includes a hook to hook to the mounting member and to swingably lock the bottom plate of the sheet reentry path; and a biasing member configured to apply a biasing force to bias the hook toward a given swing stop position, wherein the release operating unit is an operating unit configured to apply a force to the hook to separate from the given swing stop position against the biasing force exerted by the biasing member.

5. The image forming apparatus according to claim 4, wherein the release operating unit is at a position where the hook moves in a direction to separate from the given swing stop position as the release operating unit is pressed upward.

6. The image forming apparatus according to claim 5, wherein the release operating unit has an operation surface to be touched for operation, wherein the operation surface is tilted from both a vertical direction and a horizontal direction.

7. The image forming apparatus according to claim 6, wherein the bottom plate of the sheet reentry path supports the lock releasing unit and the release operating unit.

8. The image forming apparatus according to claim 7, wherein the hook is hooked at an upper end of the mounting member.

9. The image forming apparatus according to claim 5, wherein the bottom plate of the sheet reentry path supports the lock releasing unit and the release operating unit.

10. The image forming apparatus according to claim 9, wherein the hook is hooked at an upper end of the mounting member.

11. The image forming apparatus according to claim 4, wherein the release operating unit is at a position where the hook moves in a direction to separate from the given swing stop position as the release operating unit is pressed downwardly.

12. The image forming apparatus according to claim 11, wherein the bottom plate of the sheet reentry path supports the lock releasing unit and the release operating unit.

13. The image forming apparatus according to claim 12, wherein the hook is hooked at an upper end of the mounting member.

14. The image forming apparatus according to claim 12, further comprising a linked lifter configured to lift the bottom plate of the sheet reentry path from the second position to the first position in conjunction with movement of the sheet container as the sheet container is pressed into the apparatus body in a state in which the bottom plate is located at the second position and the inside of the sheet reentry path is exposed to the space.

15. The image forming apparatus according to claim 4, wherein the bottom plate of the sheet reentry path supports the lock releasing unit and the release operating unit.

16. The image forming apparatus according to claim 15, wherein the hook is hooked at an upper end of the mounting member.

17. The image forming apparatus according to claim 15, further comprising a linked lifter configured to lift the bottom plate of the sheet reentry path from the second position to the first position in conjunction with movement of the sheet container as the sheet container is pressed into the apparatus body in a state in which the bottom plate is located at the second position and the inside of the sheet reentry path is exposed to the space.

18. An image forming apparatus comprising:

an image forming part to form an image on a recording medium having a first surface and a second surface;

an apparatus body to contain the image forming part therein;

a sheet container detachably attachable to the apparatus body and to accommodate the recording medium to be supplied to the image forming part;

a sheet conveying path through which the recording medium is conveyed from the sheet container toward the image forming part;

a sheet reentry path located above the sheet container in the apparatus body and through which the recording medium having the image formed on the first surface thereof by the image forming part is conveyed again to the sheet conveying path to receive an image on the second surface of the recording medium, the sheet reentry path having a floor including at least a bottom plate;

a swing unit configured to swingably move the bottom plate between a first position to form the floor of the sheet reentry path and a second position to expose an inside of the sheet reentry path toward a space generated in the apparatus body by detachment of the sheet container as the bottom plate of the floor of the sheet reentry path swings;

a lock releasing unit provided in the apparatus body and configured to lock and release the bottom plate of the sheet reentry path with respect to the first position of the swing unit;

a release operating unit configured to cause the lock releasing unit to release the bottom plate from the first position of the swing unit; and a rotary contact member configured to contact the sheet container when the sheet container is inserted into the apparatus body in a state in which the bottom plate of the sheet reentry path is located at the second position and the inside of the sheet reentry path is exposed to the space.

19. The image forming apparatus according to claim 18, wherein the apparatus body has an opening formed when the sheet container is detached therefrom, wherein the release operating unit is in an area visible through the opening within a whole space inside the apparatus body.

20. The image forming apparatus according to claim 18, wherein the apparatus body includes a mounting member that is fixedly attached thereto, wherein the lock releasing unit includes a hook to hook to the mounting member and to swingably lock the bottom plate of the sheet reentry path; and a biasing member configured to apply a biasing force to bias the hook toward a given swing stop position, wherein the release operating unit is an operating unit configured to apply a force to the hook to separate from the given swing stop position against the biasing force exerted by the biasing member.

21. The image forming apparatus according to claim 20, wherein the release operating unit is located at a position where the hook moves in a direction to separate from the given swing stop position as the release operating unit is pressed upward.

22. The image forming apparatus according to claim 21, wherein the release operating unit has an operation surface to be touched for operation, wherein the operation surface is tilted from both a vertical direction and a horizontal direction.

23. The image forming apparatus according to claim 22, wherein the bottom plate of the sheet reentry path supports the lock releasing unit and the release operating unit.

24. The image forming apparatus according to claim 23, wherein the hook is hooked at an upper end of the mounting member.

25. The image forming apparatus according to claim 21, wherein the bottom plate of the sheet reentry path supports the lock releasing unit and the release operating unit.

26. The image forming apparatus according to claim 25, wherein the hook is hooked at an upper end of the mounting member.

27. The image forming apparatus according to claim 21, wherein the release operating unit is disposed at a position where the hook moves in a direction to separate from the given swing stop position as the release operating unit is pressed downwardly.

28. The image forming apparatus according to claim 26, wherein the bottom plate of the sheet reentry path supports the lock releasing unit and the release operating unit.

29. The image forming apparatus according to claim 28, wherein the hook is hooked at an upper end of the mounting member.

30. The image forming apparatus according to claim 21, wherein the bottom plate of the sheet reentry path supports the lock releasing unit and the release operating unit.

31. The image forming apparatus according to claim 30, wherein the hook is hooked at an upper end of the mounting member.

32. The image forming apparatus according to claim 30, further comprising a linked lifter to lift the bottom plate of the sheet reentry path from the second position to the first position in conjunction with movement of the sheet container as the sheet container is pressed into the apparatus body in a state in which the bottom plate is located at the second position and the inside of the sheet reentry path is exposed to the space.

33. The image forming apparatus according to claim 19, wherein the apparatus body includes a mounting member that is fixed therein, wherein the lock releasing unit includes a hook to hook to the mounting member and to swingably lock the bottom plate of the sheet reentry path;

and a biasing member configured to apply a biasing force to bias the hook toward a given swing stop position, wherein the release operating unit is an operating unit configured to apply a force to the hook to separate from the given swing stop position against the biasing force exerted by the biasing member.

* * * * *